US006887190B1

(12) United States Patent
Azari

(10) Patent No.: US 6,887,190 B1
(45) Date of Patent: May 3, 2005

(54) FULL BODY EXERCISE APPARATUS

(76) Inventor: John Azari, 4312 Alton Rd., Miami Beach, FL (US) 33140

( * ) Notice: Subject to any disclaimer, the term of this patent is extended or adjusted under 35 U.S.C. 154(b) by 277 days.

(21) Appl. No.: 10/152,052

(22) Filed: May 21, 2002

(51) Int. Cl.[7] ..... A63B 21/02
(52) U.S. Cl. ..... 482/142; 482/129; 482/123
(58) Field of Search ..... 482/123, 129, 482/130, 140, 142, 148, 133, 138, 121, 145, 482/907

(56) References Cited

U.S. PATENT DOCUMENTS 5,387,171 A * 2/1995 Casey et al.
6,152,866 A * 11/2000 Kuo

* cited by examiner

*Primary Examiner*—Jerome W. Donnelly
(74) *Attorney, Agent, or Firm*—Gold & Rizvi, P.A.; H. John Rizvi; Glenn E. Gold

(57) ABSTRACT

A full body exercise apparatus capable of permitting a user to conveniently develop and condition an extremely broad cross section of muscle groups so as to provide a full body workout. The full body exercise apparatus includes a bottom frame structure having a front end portion, a rear end portion, and a central axis extending therebetween. A seat pad and knee pad are provided near the central axis for user comfort. Stabilizer arms extend horizontally from the central axis to provide stability to the full body exercise apparatus. A pole section is removably secured to the bottom frame structure and extends perpendicularly upwards. A plurality of tension members are removably secured throughout the full body exercise apparatus and include a handle thereupon.

12 Claims, 20 Drawing Sheets

FULL BODY EXERCISE APPARATUS

BACKGROUND OF THE INVENTION

1. Field of the Invention

The present invention relates generally to exercise and athletic equipment used for muscle development, and more particularly to a full body exercise apparatus for developing and conditioning an extremely broad cross section of muscle groups in a relatively free-style manner so as to provide an improved full body workout.

2. Description of the Prior Art

The health benefits associated with regular participation in muscle conditioning or development exercises are well known. In this regard, the use of specialized equipment to assist in body contouring and strategic development of the musculature is ever increasing in popularity.

Many existing apparatuses, however, are focused solely upon developing a particular section of the human musculature, such as the biceps, for example, and are anatomy-specific in their application and usage.

Additionally, conventional exercise equipment has been generally focused upon common problem areas, such as the abdomen or buttocks, and such equipment strategically isolates limited muscle groups for development. Other devices have a slightly broader application and provide for development of either the upper or lower body in a single machine. It is seen that such equipment does not provide the capability of conditioning and developing a complete cross-section of muscle groups in a single machine. Additionally, existing equipment unduly restricts a user's range of movement and does not take advantage of cross-muscular development typically only associated with the use of free weights.

A myriad of attempts have been made to provide an exercise apparatus for muscle conditioning and development for a broad cross section of muscle groups to provide a total body workout. Although a variety of structural combinations and configurations have been devised, existing attempts at providing full-body musculature conditioning and development have not overcome a number of disadvantages. As an initial matter, such equipment typically mandates that user movement be carefully restricted and thus deprives the user of many of the benefits of cross-muscular development that is often associated with the use of free weights. Furthermore, such equipment has generally required the use of heavy weights to provide resistance to a user as well as bulky and cumbersome structural configurations. These attempts have also required a relatively complex- and expensive manufacturing process as well as awkward and time-consuming assembly by end users.

Accordingly, there is an established need for a lightweight and practical full body exercise apparatus that overcomes the aforementioned disadvantages and allows a user to conveniently develop and condition an extremely broad cross section of muscle groups so as to provide a full body workout.

SUMMARY OF THE INVENTION

The present invention is directed to a full body exercise apparatus for developing and conditioning an extremely broad cross section of muscle groups in a free-style manner so as to provide a full body workout to users. The exercise apparatus of the present invention is configured to be lightweight and easy to use so as to provide a practical and convenient solution to full body musculature development.

An object of the present invention is to provide a full body exercise apparatus capable of conditioning and developing any of a wide cross section of muscles.

A further object of the present invention is to provide a full body exercise apparatus that is relatively easy to manufacture, simple to set up and use, and mechanically sound in design.

Another object of the present invention is to provide a full body exercise apparatus that is relatively lightweight in configuration.

An additional object of the present invention is to provide a full body exercise apparatus that eliminates the need for additional weights to be utilized in conjunction with the apparatus.

In accordance with a first aspect of the invention, a full body exercise apparatus is provided comprising a bottom frame structure having a front end portion, a rear end portion, and a central axis therebetween. A seat pad and knee pad are provided near the central axis for user comfort. Stabilizer arms extend horizontally from the central axis to provide stability to the full body exercise apparatus. A pole section is removably secured to the bottom frame structure and extends perpendicularly upwards. A plurality of tension members are removably secured throughout the full body exercise apparatus and include a handle thereupon.

Another object of the present invention is to provide a full body exercise apparatus that permits complete freedom of movement to a user so that the benefits from cross-muscular conditioning and development typically only associated with the use of free weights.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements; and in which.

Like reference numerals refer to like parts throughout the several views of the drawings.

DETAILED DESCRIPTION OF THE PREFERRED EMBODIMENTS

Shown throughout the figures, the present invention is generally directed towards a full-body exercise apparatus for developing and conditioning an extremely broad cross section of muscle groups in a free-style manner so as to provide a full body workout to users.

Figure 2:
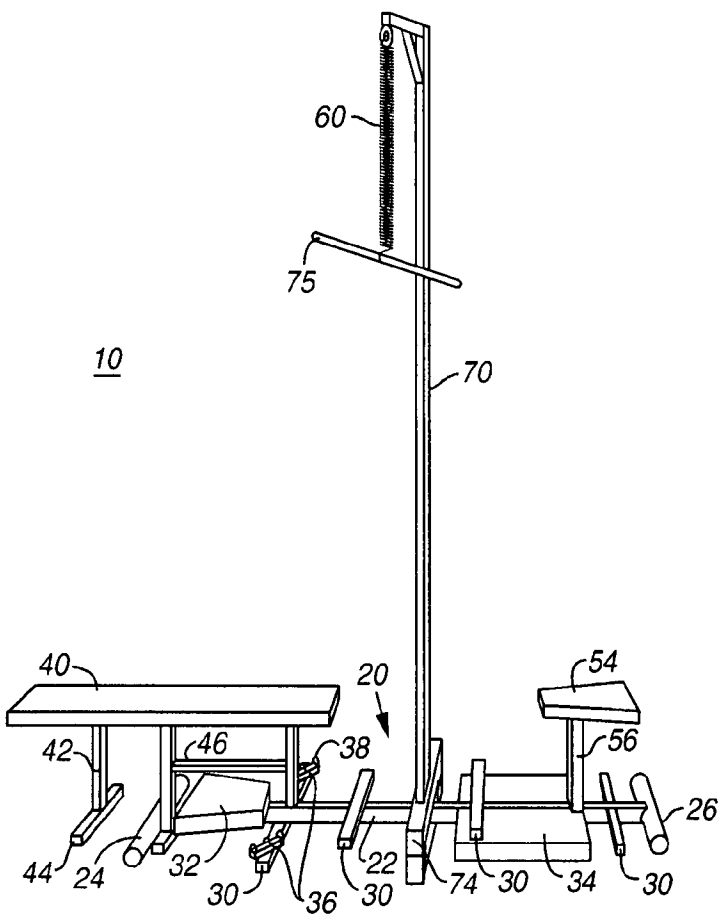
FIG. 2 is a perspective side view of a preferred embodiment of the exercise apparatus shown without the leg extension shown.
Figure 1:
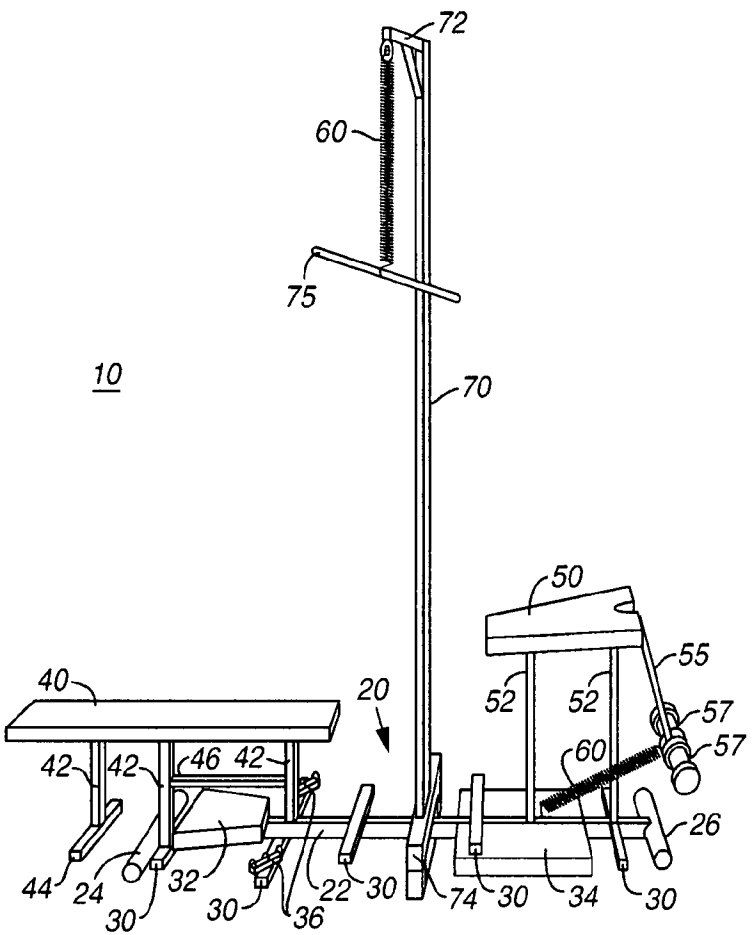
FIG. 1 is a perspective side view of a preferred embodiment of the exercise apparatus of the present invention.

Referring now to FIGS. 1 and 2, the preferred embodiment of the full-body exercise apparatus 10 of the present invention is shown in its fully assembled configuration. The full-body exercise apparatus 10 of FIG. 1 is configured to permit leg extension exercises to be performed while the full-body exercise apparatus 10 of FIG. 2 shows an alternative embodiment without leg extension exercise capabilities.

Referring to FIGS. 1 and 2, the components of the full-body exercise apparatus 10 will now be described. In the preferred embodiment, the full-body exercise apparatus 10 will preferably include a bottom frame structure 20 as shown. The bottom frame structure 20 may be formed in any of a wide variety of shapes and structural configurations without departing from the present invention. In the preferred embodiment, the bottom frame structure 20 will preferably include a front end portion 24, a rear end portion 26, and a central axis 22 extending therebetween. If desired, a number of stabilizing arms 30 may be provided as shown in the figures. In a most preferred embodiment, the stabilizing arms will include rotating pedals thereupon as shown in the figures. Additionally, it will be appreciated that a seat pad 32 may be provided as well as a knee pad 34 for user comfort as will become clear later.

A raised bench portion 40 may be provided, as shown, for use during a variety of exercises as will become clear later. The raised bench portion 40 will preferably be configured with a number of legs 42 as shown. In the preferred embodiment, the raised bench portion 40 will be configured to be removably secured to the central axis 22 of the bottom frame structure 20. This can be accomplished in utilizing any of a wide variety of known methods without departing from the present invention. In the preferred embodiment, the central axis 22 of the bottom frame structure 20 will have apertures formed therein to receive and secure the legs 42 of the raised bench portion 40. For added stability, at least one of the legs 42 of the raised bench portion 40 may be provided with stabilizing arms 44 as shown in the figures. Additionally, if desired, a leg stabilizing bar 46 may be utilized as well.

In the preferred embodiment, the full-body exercise apparatus 10 may be provided with a raised seat portion 50 with a number of legs 52 removably secured to the bottom frame structure 20 as shown in FIG. 1. The raised seat portion 50 may be removably secured to the central axis 22 of the bottom frame structure 20 by utilizing any of a wide variety of known methods without departing from the present invention. In the preferred embodiment, the central axis 22 of the bottom frame structure 20 will have apertures formed therein to receive and secure the legs 52 of the raised seat portion 50. In order to permit a user to perform a variety of leg exercises using the full-body exercise apparatus 10, a hinged leg extension rod 55 having support members 57 may be provided as shown in FIG. 1. A tension member 60 may be secured as shown. The tension member 60 may be formed of any of a wide variety of materials and configurations without departing from the present invention. In the preferred embodiment, however, the tension member 60 will be a tightly coiled spring as shown in the figures configured to provide a resistance force when stretched. In an alternative embodiment, a low elevation raised seat portion 54, as shown in FIG. 2, may be provided as shown in FIG. 2. The low elevation raised seat portion 54 is not configured for leg exercises. In this embodiment, a raised seat portion 54 is removably secured to the bottom frame structure 20 by a number of legs 56 as shown.

In the preferred embodiment, the full-body exercise apparatus 10 will include a pole section 70 configured to be removably secured to the bottom frame structure 20. The central pole will preferably include a top portion 72 and a base portion 74 as shown in the figures. The top portion 72 will be configured so that a tension member 60 may be secured, as desired, to permit a variety of exercises to be performed as will be clear later. If desired, a handle 75 may also be utilized as shown. It will be appreciated by those skilled in the art that the handle shown is for illustrative purposes only and any of a wide variety of different configurations may be utilized for the handle 75 without departing from the present invention. The base portion 74 of the pole section 70 will preferably be configured so that it is removably secured to the bottom frame structure 20 of the full-body exercise apparatus 10 as shown. This may be accomplished by utilizing any of a wide variety of known methods without departing from the present invention. For example, the central axis 22 of the bottom frame structure 20 may have apertures formed therein to receive and secure the base portion 74 of the pole section 70.

As described, the full body exercise apparatus 10 of the present invention will utilize a variety of tension members 60 capable of providing a resistance force to a user. The tension members 60 will preferably be configured as a tightly coiled spring. In the preferred embodiment, connection means will be preferably be provided to removably secure the tension members 60 to the full body exercise apparatus 10. Any of a wide variety of connection means may be utilized, as desired, without departing from the present invention. In a most preferred embodiment, the connection means will comprise eyelets 38 as illustrated throughout the figures.

It will be appreciated by those skilled in the art that the full body exercise apparatus 10 of the present invention may be formed from any of a wide variety of known materials without departing from the present invention. In the preferred embodiment, the structural components of the exercise apparatus 10 will be formed of hollow tubular members. The tubular members may be configured from any of a variety of cross sections, as desired, such as square or round, for example, without departing from the present invention. In the most preferred embodiment, the hollow tubular members will be formed out of a lightweight metal such as Aluminum.

Figure 3B:
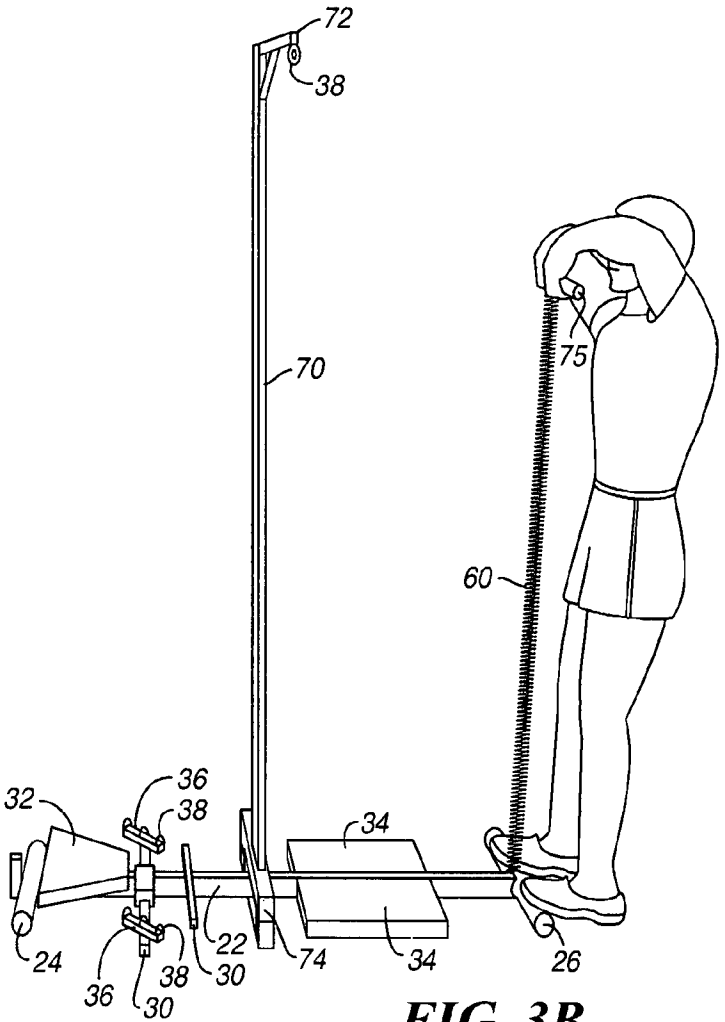
FIG. 3B is a perspective side view of a preferred embodiment of the exercise apparatus shown employed by a user in a second position during an upright rowing exercise.
Figure 3A:
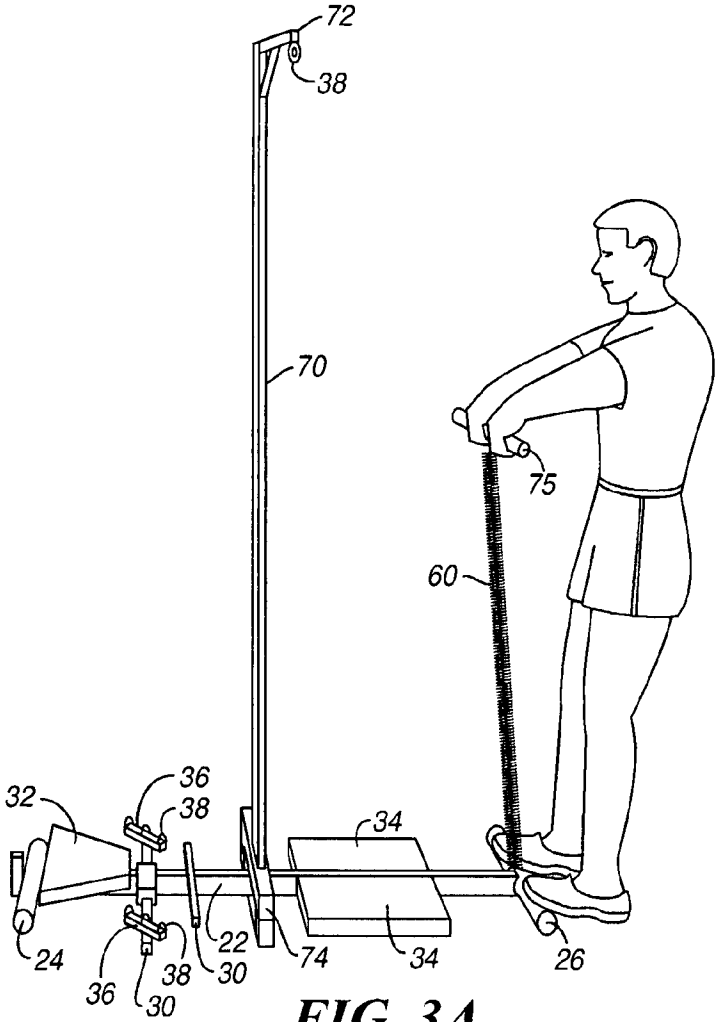
FIG. 3A is a perspective side view of a preferred embodiment of the exercise apparatus shown employed by a user in a first position during an upright rowing exercise.

The full-body exercise apparatus 10 is shown in FIGS. 3A and 3B configured for use during an upright rowing exercise. In this configuration of the preferred embodiment, the raised bench portion 40 and raised seat portion 50 may be removed as shown. If desired, of course, the pole section 70 may also be removed. In FIG. 3A, the full-body exercise apparatus 10 is shown employed by a user in a first position. The full-body exercise apparatus 10 of the present invention is shown employed by a user in a second position in FIG. 3B. As illustrated, a tension member 60 is employed to provide resistance during the exercise.

Figure 4B:
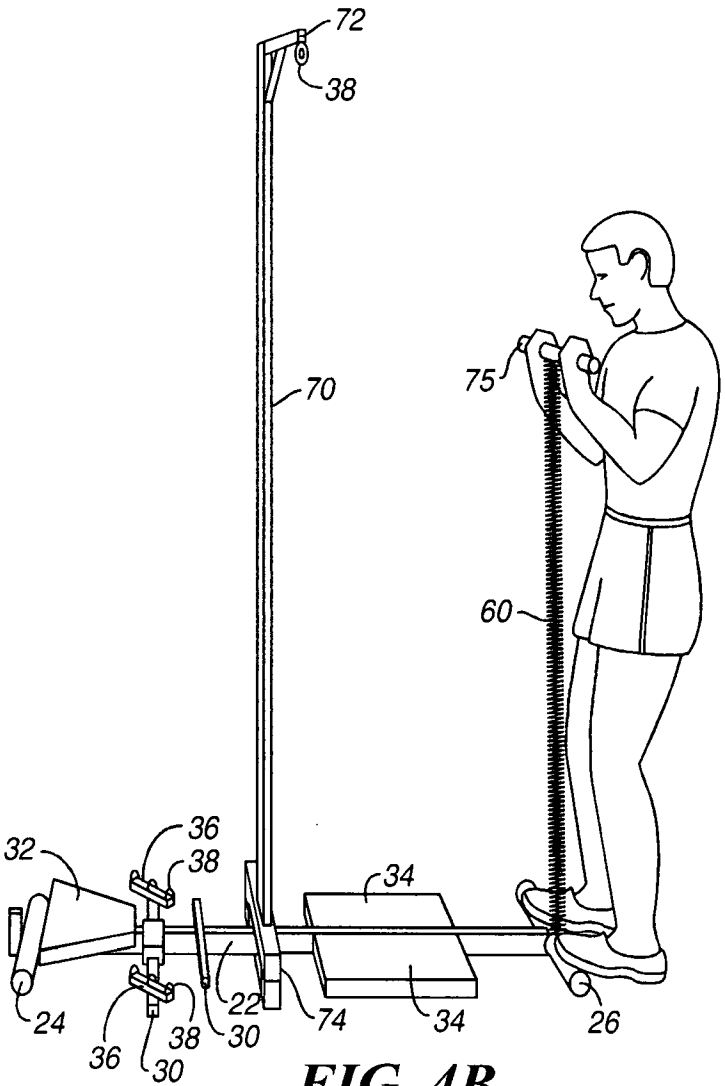
FIG. 4B is a perspective side view of a preferred embodiment of the exercise apparatus shown employed by a user in a second position during an standing bicep curl.
Figure 4A:
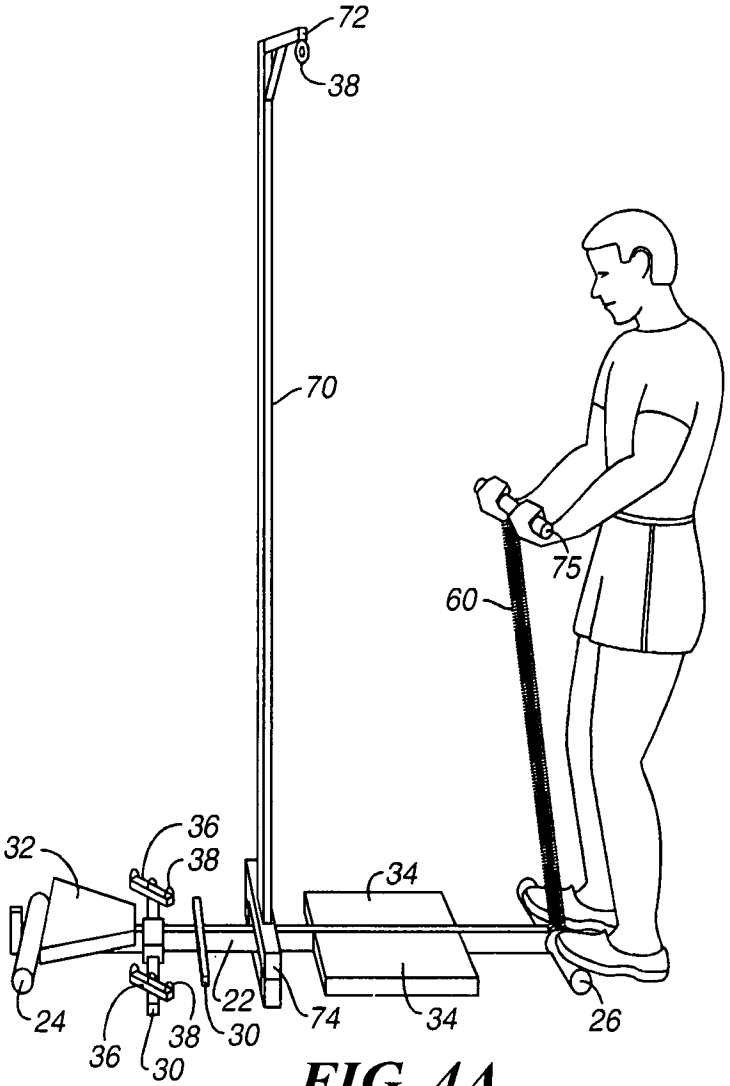
FIG. 4A is a perspective side view of a preferred embodiment of the exercise apparatus shown employed by a user in a first position during a standing bicep curl.

The full-body exercise apparatus 10 is shown in FIGS. 4A and 4B configured for use during a standing bicep curl. In this configuration of the preferred embodiment, the raised bench portion 40 and raised seat portion 50 may be removed as shown. If desired, of course, the pole section 70 may also be removed. In FIG. 4A, the full-body exercise apparatus 10 is shown employed by a user in a first position during a standing bicep curl exercise. The full-body exercise apparatus 10 of the present invention is shown employed by a user in a second position during a standing bicep curl exercise in FIG. 4B. As illustrated, a tension member 60 is employed to provide resistance during the exercise.

Figure 5B:
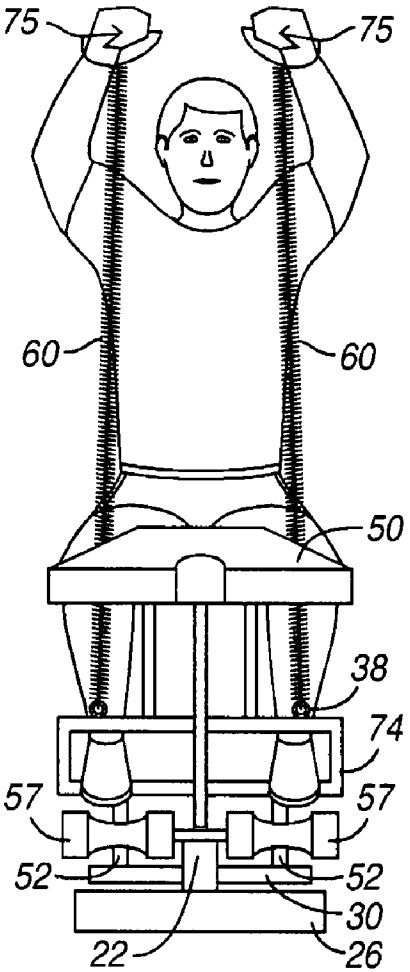
FIG. 5B is a perspective front view of a preferred embodiment of the exercise apparatus shown employed by a user in a second position during a shoulder press exercise.
Figure 5A:
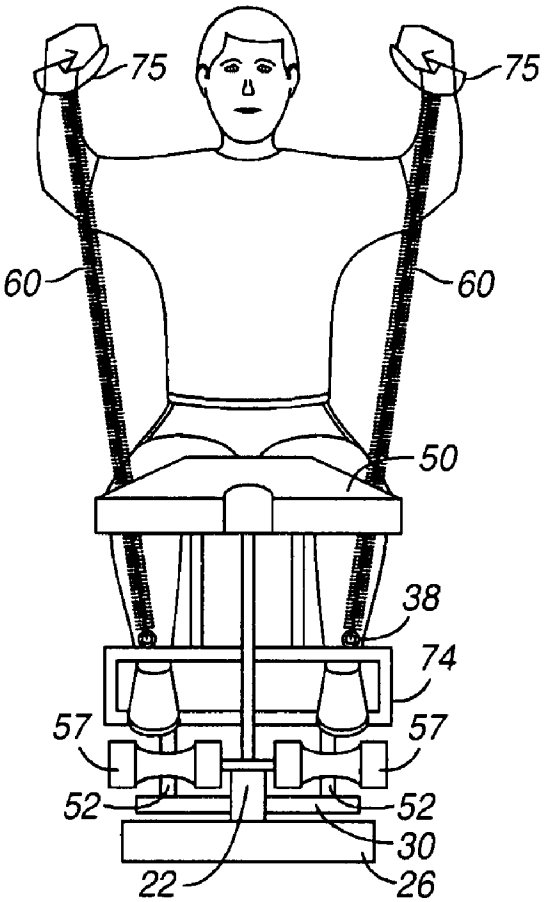
FIG. 5A is a perspective front view of a preferred embodiment of the exercise apparatus shown employed by a user in a first position during a shoulder press exercise.

The full-body exercise apparatus 10 is shown in FIGS. 5A and 5B configured for use during a shoulder press exercise. In this configuration of the preferred embodiment, the pole section 70 will preferably be removed as shown. In FIG. 5A, the full-body exercise apparatus 10 is shown employed by a user during a first position in a shoulder press exercise. The full-body exercise apparatus 10 of the present invention is shown employed by a user in a second position during a shoulder press exercise in FIG. 5B. As illustrated, at least two tension members 60 are employed to provide resistance during the exercise. Also, as will be appreciated by those skilled in the art, the free-style nature of the tension members permit a wide variety of muscular movement during this exercise. As such, it is seen that the position shown illustrated in FIG. 5B utilizes the lateral deltoid muscles.

Figure 6B:
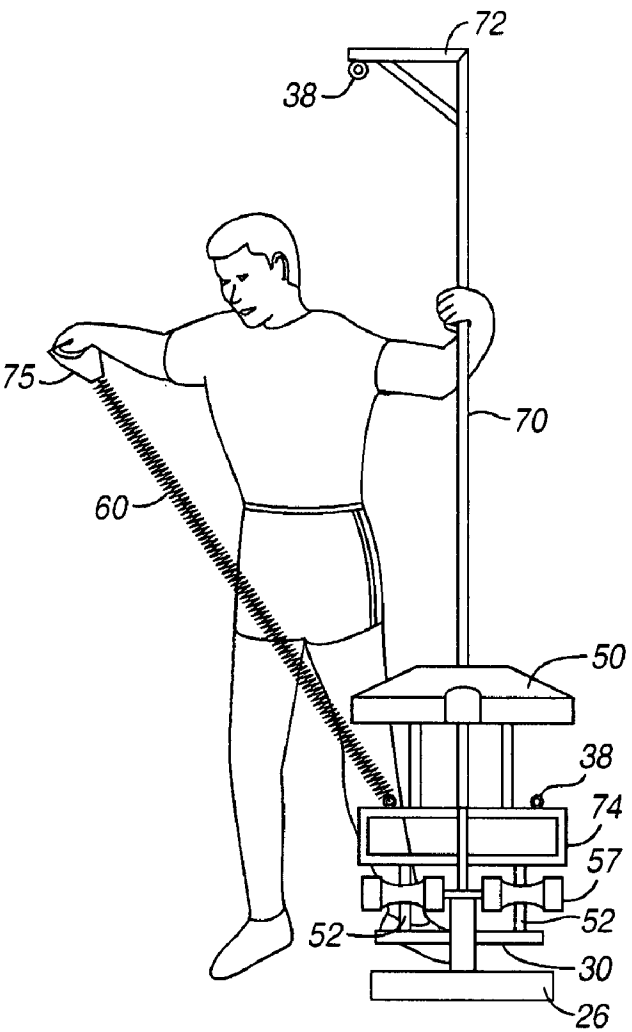
FIG. 6B is a perspective front view of a preferred embodiment of the exercise apparatus shown employed by a user in a second position during a lateral raise exercise.
Figure 6A:
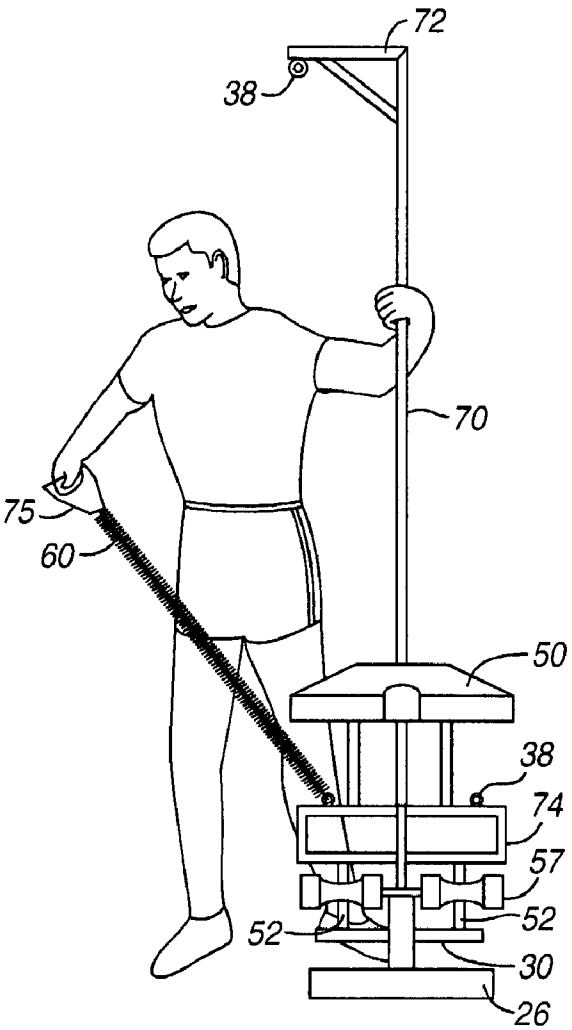
FIG. 6A is a perspective front view of a preferred embodiment of the exercise apparatus shown employed by a user in a first position during a lateral raise exercise.

The full-body exercise apparatus 10 is shown in FIGS. 6A and 6B configured for use during a lateral raise exercise. In this configuration of the preferred embodiment, the raised bench portion 40 and raised seat portion 50 may be removed if desired. The pole section 70 will preferably be utilized, as-shown in FIGS. 6A and 6B, to provide a user with a support surface as illustrated. In FIG. 6A, the full-body exercise apparatus 10 is shown employed by a user in a first position during a lateral raise exercise. The full-body exercise apparatus 10 of the present invention is shown employed by a user in a second position during a lateral raise exercise in FIG. 6B. As illustrated, a tension member 60 is employed to provide resistance during the exercise. Although right handed use is illustrated in FIGS. 6A and 6B, left handed use is also contemplated and will be a mirror image thereof.

Figure 7B:
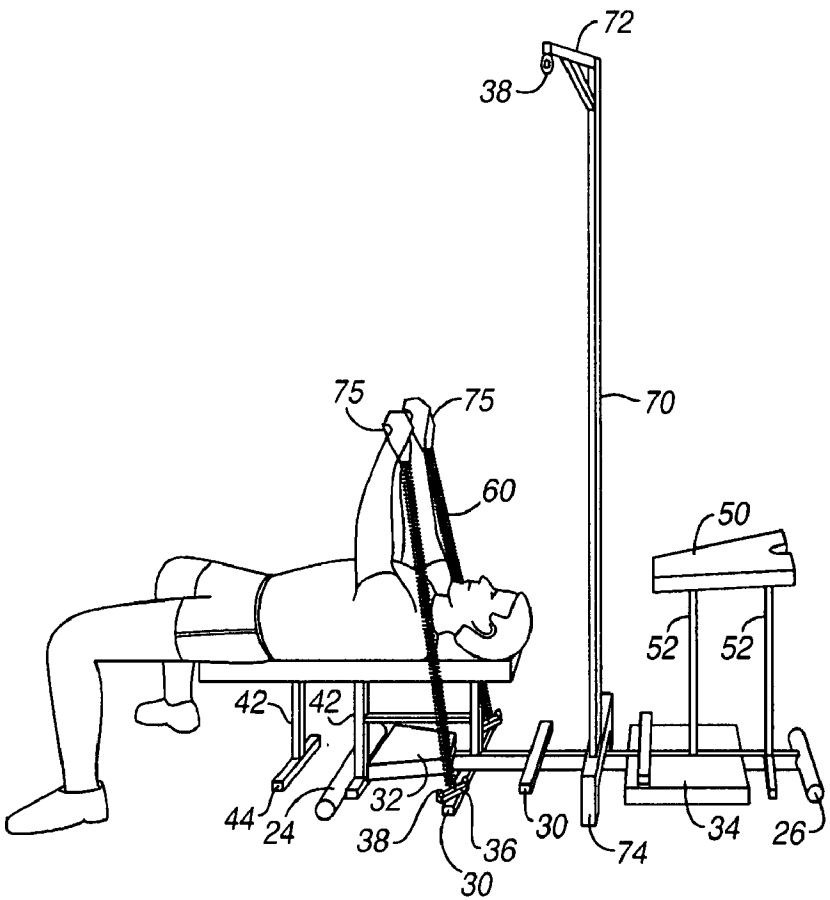
FIG. 7B is a perspective side view of a preferred embodiment of the exercise apparatus shown employed by a user in a second position during a bench press exercise.
Figure 7A:
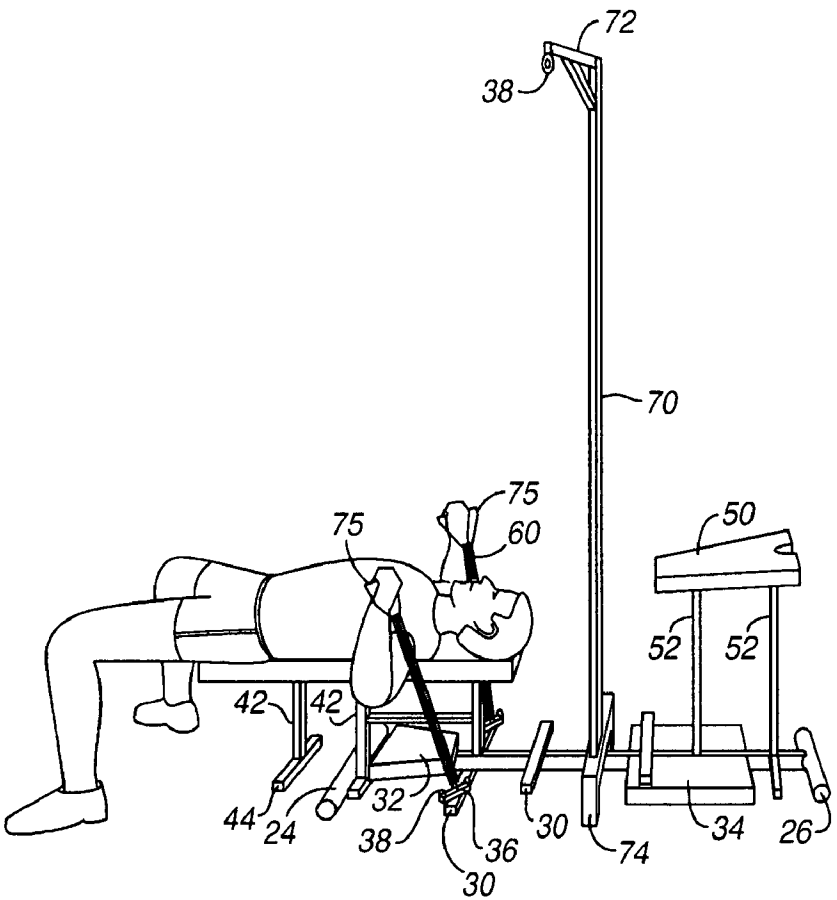
FIG. 7A is a perspective side view of a preferred embodiment of the exercise apparatus shown employed by a user in a first position during a bench press exercise.

The full-body exercise apparatus 10 is shown in FIGS. 7A and 7B and configured for use during a bench press exercise. In FIG. 7A, the full-body exercise apparatus 10 is shown employed by a user during a first position in a bench press exercise. The full-body exercise apparatus 10 of the present invention is shown employed by a user in a second position during a bench press exercise in FIG. 5B. As illustrated, at least two tension members 60 are employed to provide resistance during the exercise.

Figure 8B:
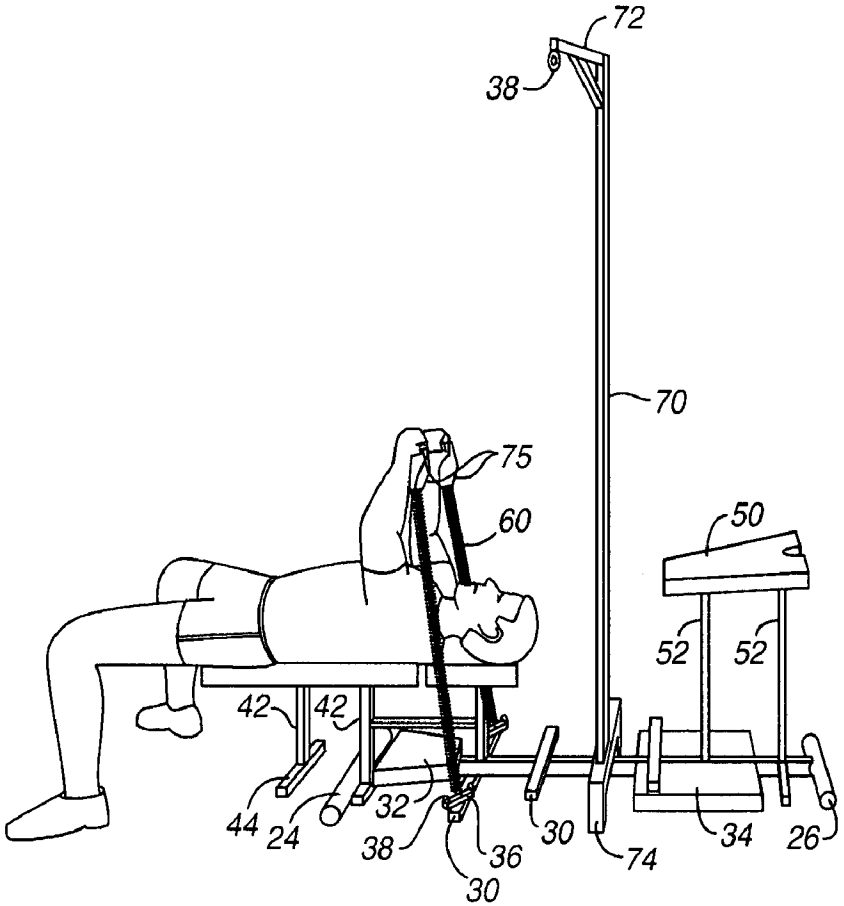
FIG. 8B is a perspective side view of a preferred embodiment of the exercise apparatus shown employed by a user in a second position during a fly exercise.
Figure 8A:
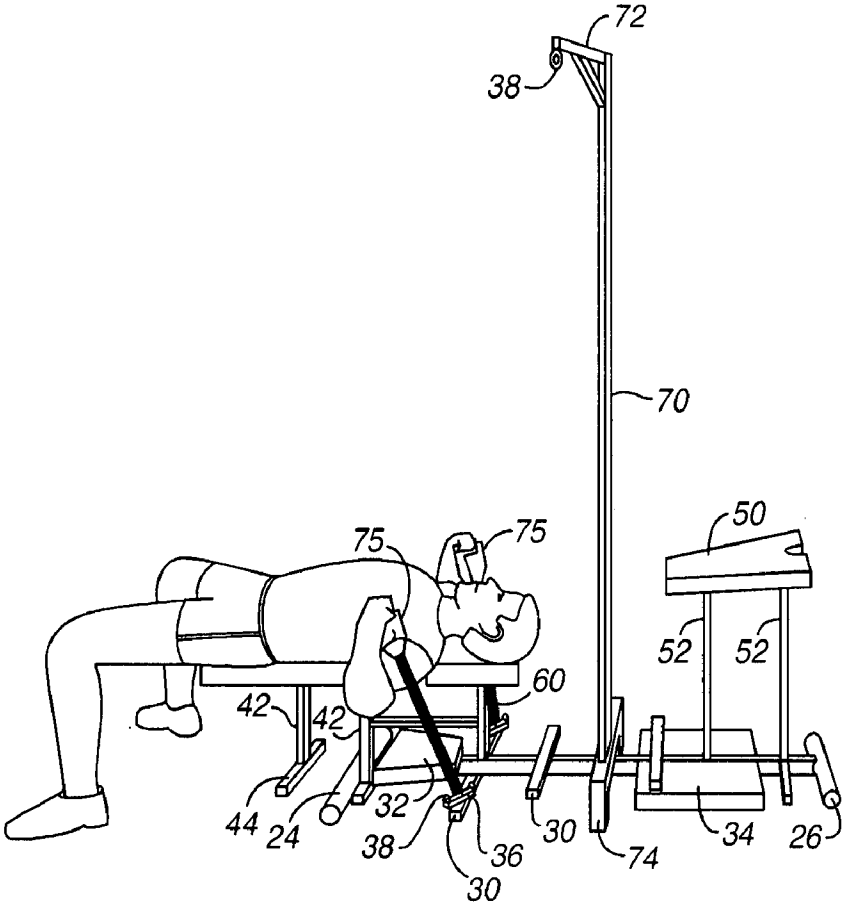
FIG. 8A is a perspective side view of a preferred embodiment of the exercise apparatus shown employed by a user in a first position during a fly exercise.

The full-body exercise apparatus 10 is shown in FIGS. 8A and 8B configured for use during a fly exercise. In FIG. 8A, the full-body exercise apparatus 10 is shown employed by a user during a first position in the fly exercise. The full-body exercise apparatus 10 of the present invention is shown employed by a user in a second position during the fly exercise in FIG. 5B. As illustrated, at least two tension members 60 are preferably employed to provide resistance during this exercise.

Figure 9B:
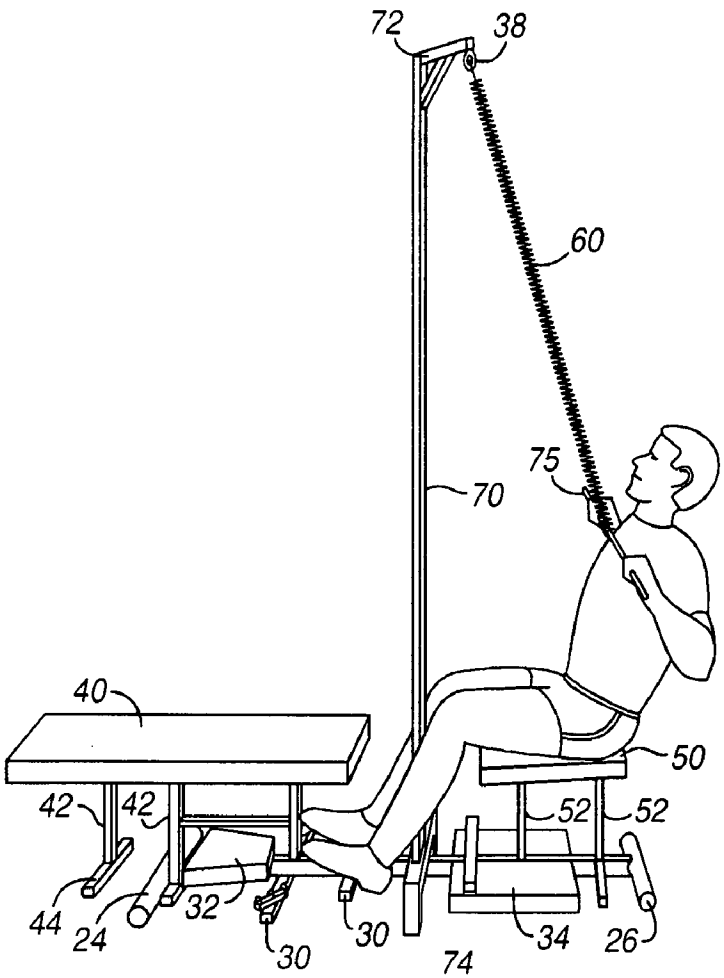
FIG. 9B is a perspective side view of a preferred embodiment of the exercise apparatus shown employed by a user in a second position during a front lat pull exercise.
Figure 9A:
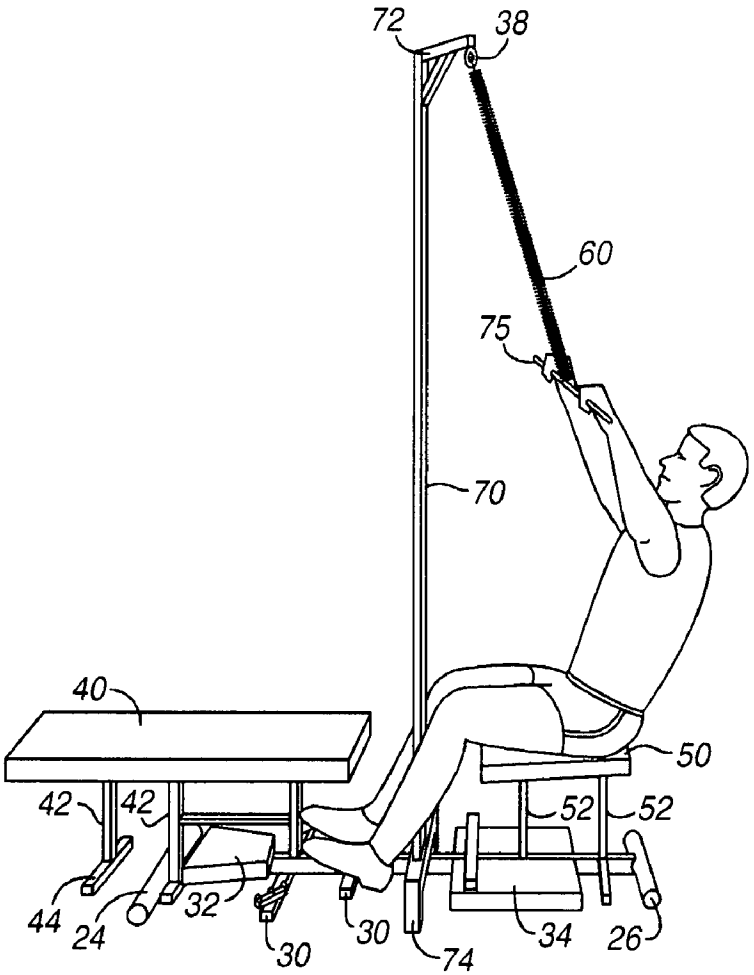
FIG. 9A is a perspective side view of a preferred embodiment of the exercise apparatus shown employed by a user in a first position during a front lat pull exercise.

The full-body exercise apparatus 10 is shown in FIGS. 9A and 9B configured for use during a front lat pull exercise. In this configuration of the preferred embodiment, the low elevation raised seat portion 54 will be utilized as shown. In FIG. 9A, the full-body exercise apparatus 10 is shown employed by a user during a first position in the front lat pull exercise. The full-body exercise apparatus 10 of the present invention is shown employed by a user in a second position during the front lat pull exercise in FIG. 9B. As illustrated, at least one tension member 60 is employed to provide resistance during the exercise. Also, as will be appreciated by those skilled in the art, the free-style nature of the tension members permit a wide variety of muscular movement during this exercise. As such, it is seen that the user may lean back, as desired, to vary the particular muscles being conditioned during exercise as shown.

Figure 10B:
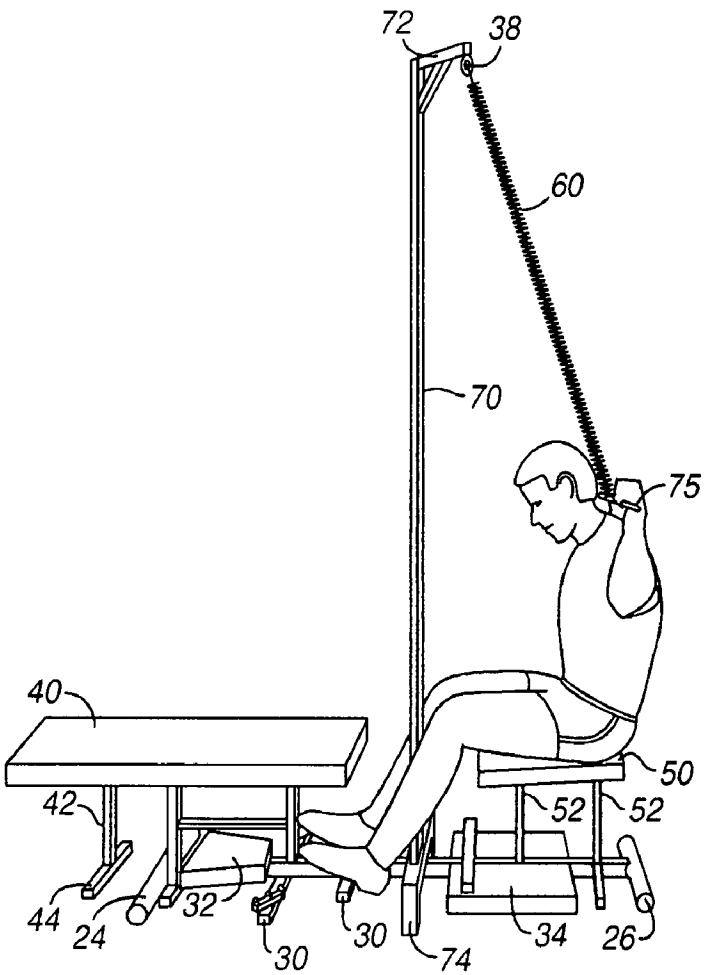
FIG. 10B is a perspective side view of a preferred embodiment of the exercise apparatus shown employed by a user in a second position during a rear lat pull exercise.
Figure 10A:
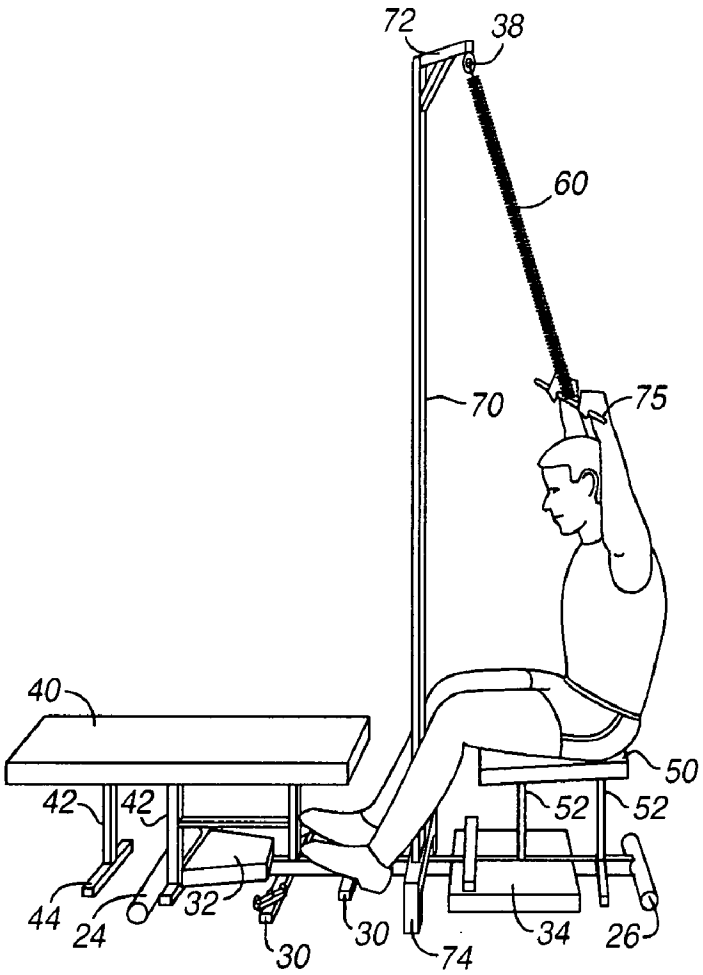
FIG. 10A is a perspective side view of a preferred embodiment of the exercise apparatus shown employed by a user in a first position during a rear lat pull exercise.

The full-body exercise apparatus 10 is shown in FIGS. 10A and 10B configured for use during a rear lat pull exercise. In FIG. 10A, the full-body exercise apparatus 10 is shown employed by a user during a first position in the rear lat pull exercise. The full-body exercise apparatus 10 of the present invention is shown in FIG. 10B as employed by a user in a second position during the rear lat pull exercise. As illustrated, at least one tension member 60 will preferably be employed to provide resistance during the exercise.

Figure 11B:
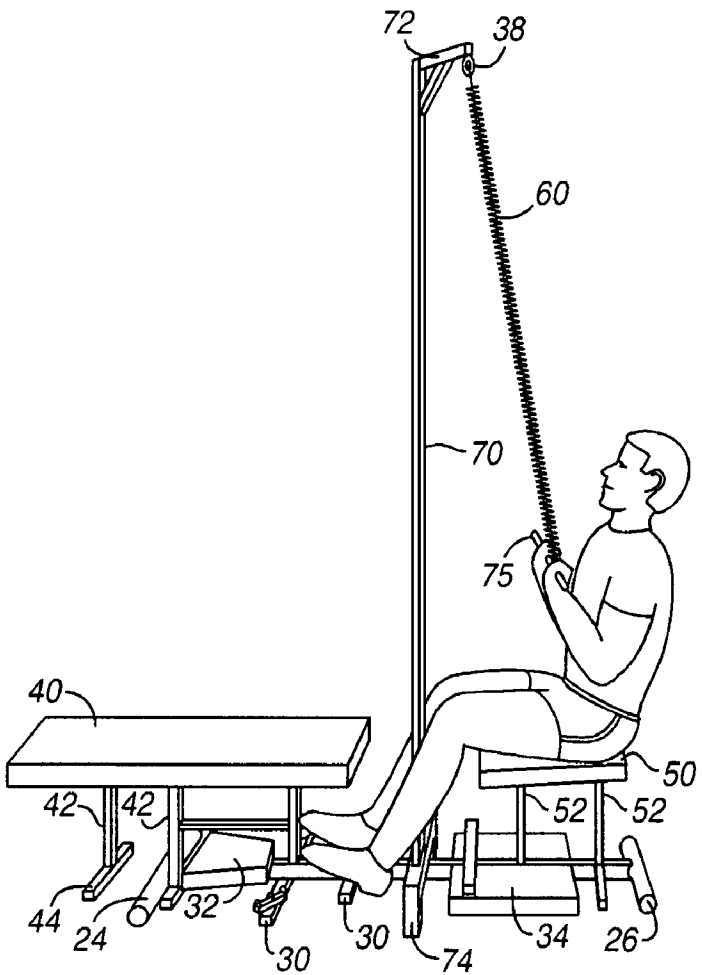
FIG. 11B is a perspective side view of a preferred embodiment of the exercise apparatus shown employed by a user in a second position during an inside grip lat pull exercise.
Figure 11A:
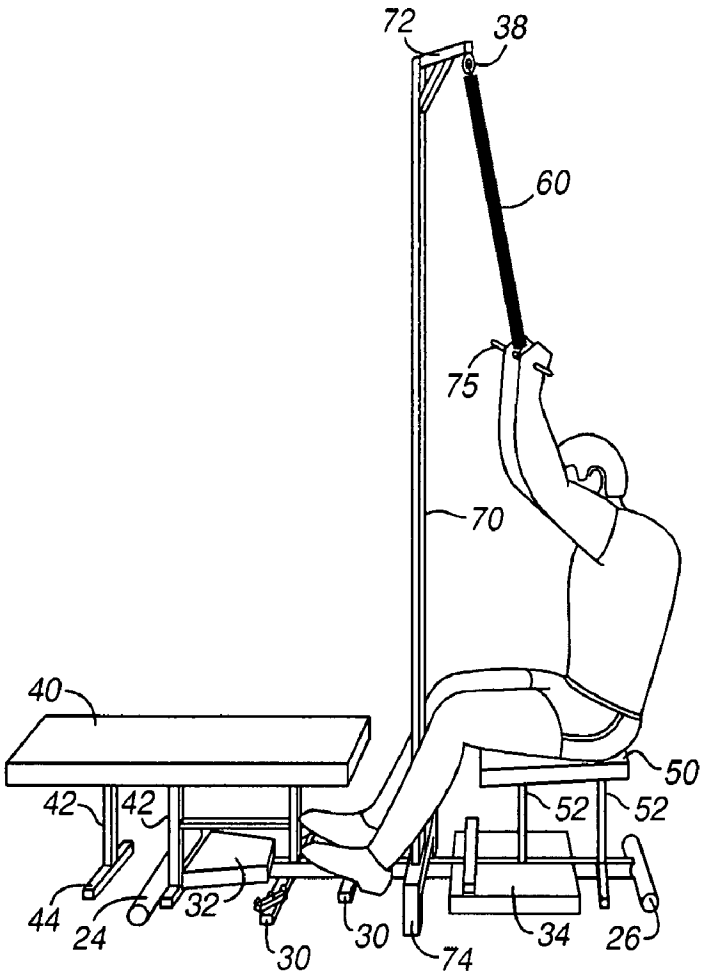
FIG. 11A is a perspective side view of a preferred embodiment of the exercise apparatus shown employed by a user in a first position during an inside grip lat pull exercise.

The full-body exercise apparatus 10 is shown in FIGS. 11A and 11B configured for use during an inside grip lat pull exercise. In FIG. 11A, the full-body exercise apparatus 10 is shown employed by a user during a first position in the inside grip lat pull exercise. The full-body exercise apparatus 10 of the present invention is shown employed by a user in a second position during the inside grip lat pull exercise in FIG. 11B. As illustrated, at least one tension member 60 is employed to provide resistance during the exercise. Also, as will be appreciated by those skilled in the art, the free-style nature of the tension members permit a wide variety of muscular movement as desired by a user. As such, it is seen that in the position illustrated in FIGS. 11A and 11B, the user is sitting in a relatively upright manner in comparison to the rearward leaning posture of FIGS. 9A and 9B.

Figure 12B:
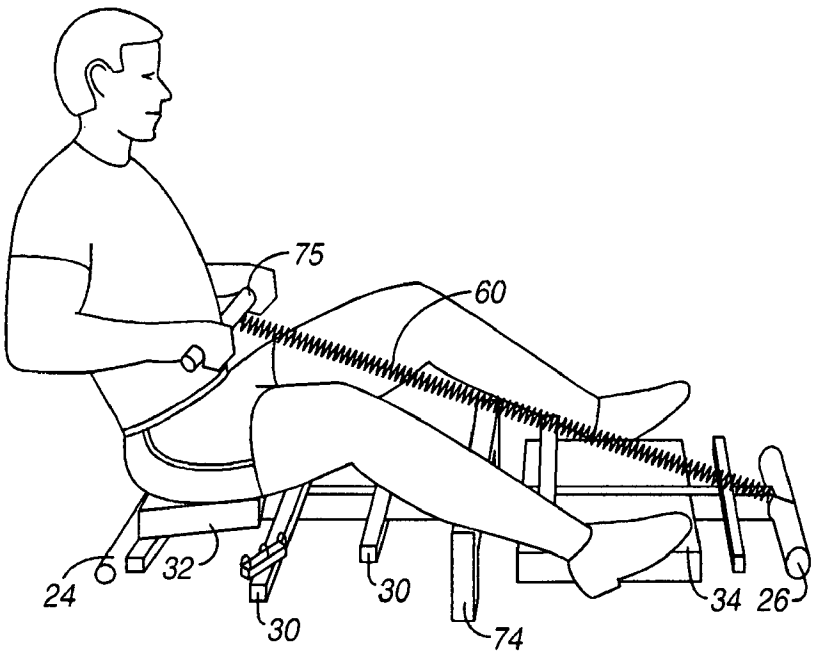
FIG. 12B is a perspective side view of a preferred embodiment of the base portion of the exercise apparatus of the present invention shown employed by a user in a second position during a rowing exercise.
Figure 12A:
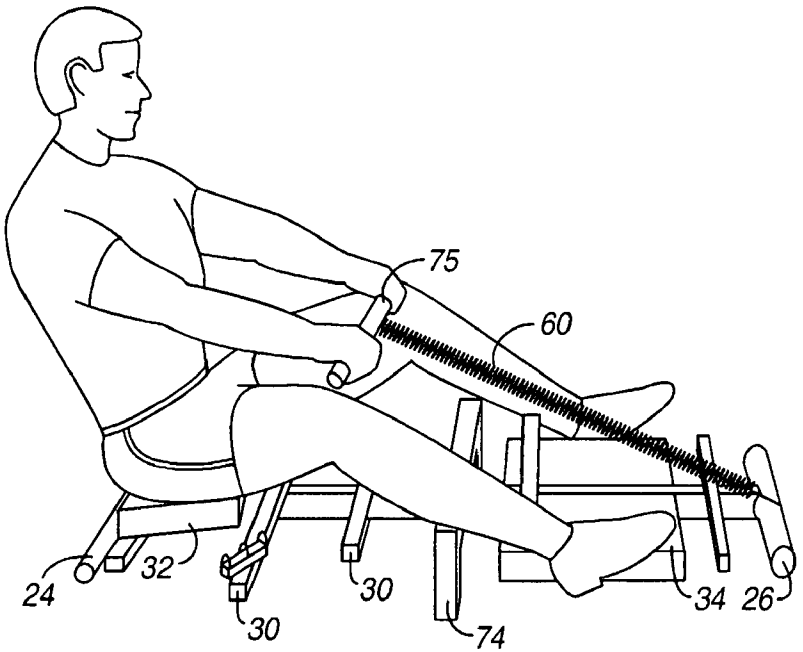
FIG. 12A is a perspective side view of a preferred embodiment of the base portion of the exercise apparatus of the present invention shown employed by a user in a first position during a rowing exercise.

The full-body exercise apparatus 10 is shown in FIGS. 12A and 12B configured for use during a rowing exercise. In this configuration of the preferred embodiment, the raised bench portion 40, raised seat portion 50, and pole section 70 will preferably be removed as shown. In FIG. 12A, the full-body exercise apparatus 10 is shown employed by a user during a first position in the rowing exercise. The full-body exercise apparatus 10 of the present invention is shown employed by a user in a second position during the rowing exercise in FIG. 12B. As illustrated, at least one tension member 60 will preferably be employed to provide resistance during the exercise.

Figure 13B:
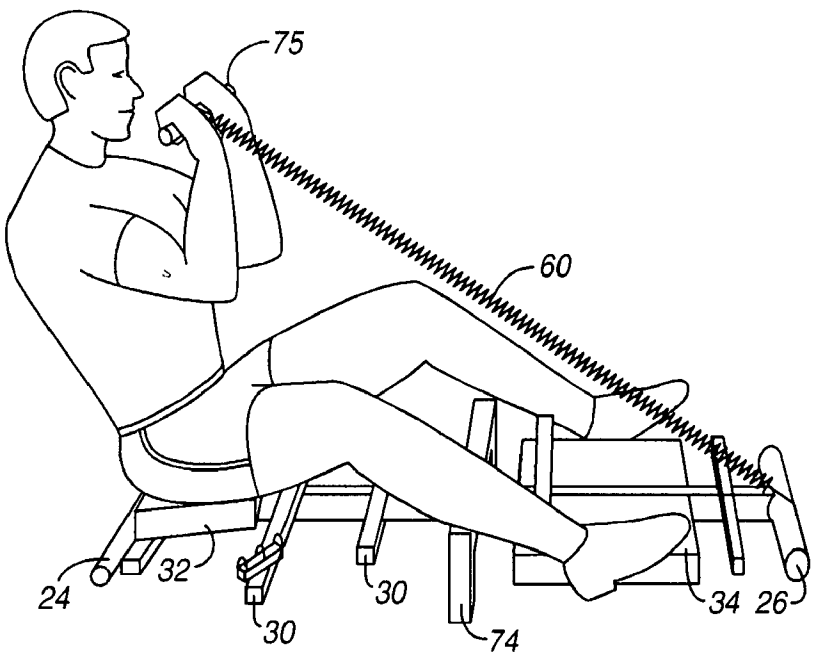
FIG. 13B is a perspective side view of a preferred embodiment of the base portion of the exercise apparatus of the present invention shown employed by a user in a second position during a sitting bicep curl exercise.
Figure 13A:
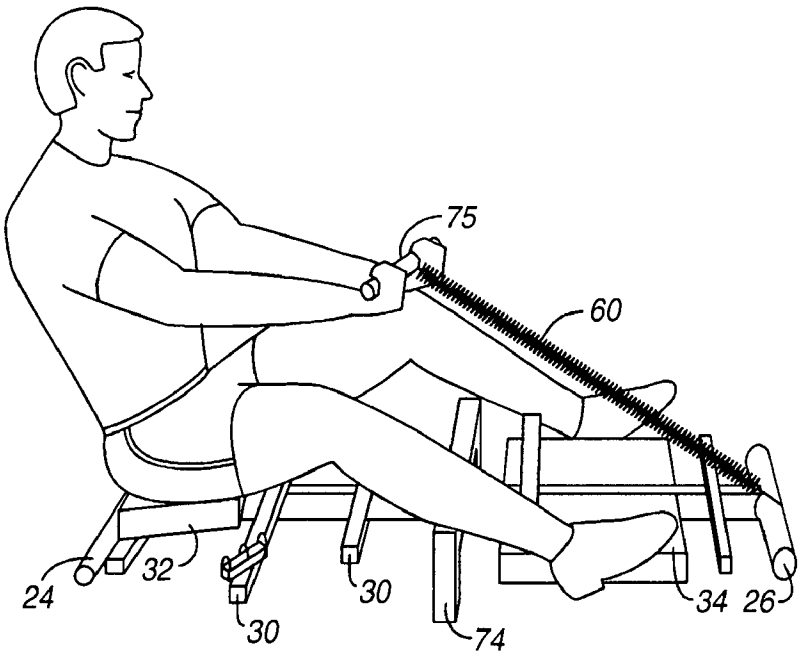
FIG. 13A is a perspective side view of a preferred embodiment of the base portion of the exercise apparatus of the present invention shown employed by a user in a first position during a sitting bicep curl exercise.

The full-body exercise apparatus 10 is shown in FIGS. 13A and 13B configured for use during a sitting bicep curl exercise. In this configuration of the preferred embodiment, the raised bench portion 40, raised seat portion 50, and pole section 70 will preferably be removed as shown. In FIG. 13A, the full-body exercise apparatus 10 is shown employed by a user during a first position in the sitting bicep curl exercise. The full-body exercise apparatus 10 of the present invention is shown employed by a user in a second position during the sitting bicep curl exercise in FIG. 13B. As illustrated, at least one tension member 60 will preferably be employed to provide resistance during the exercise.

Figure 14B:
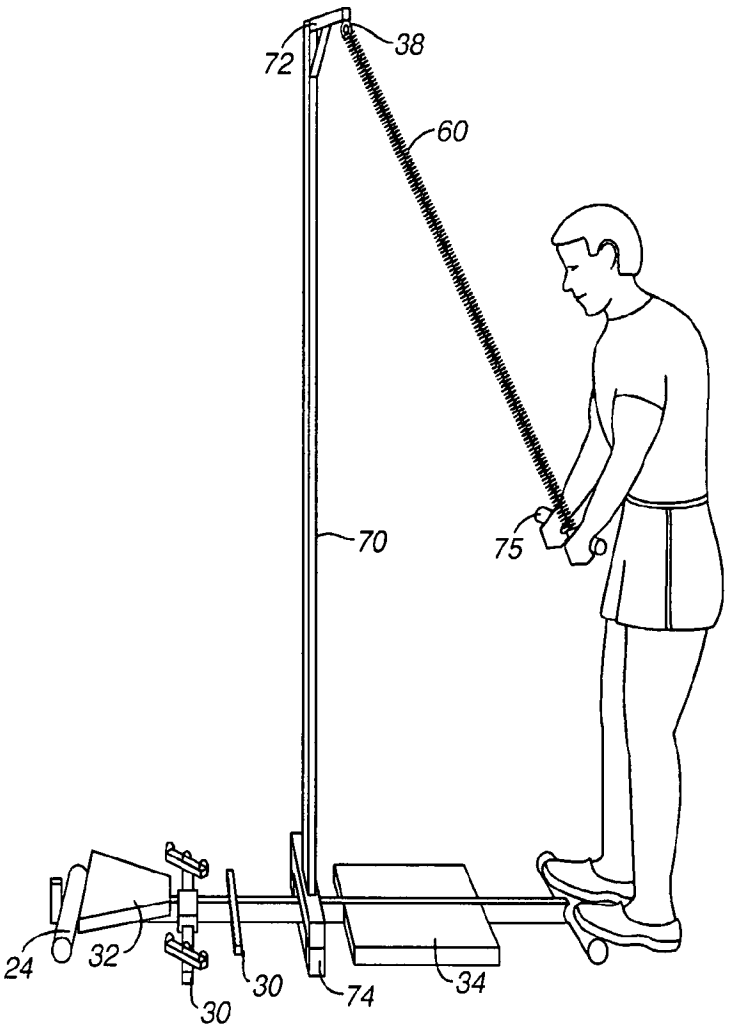
FIG. 14B is a perspective side view of a preferred embodiment of the base portion of the exercise shown employed by a user in a second position during a tricep push exercise.
Figure 14A:
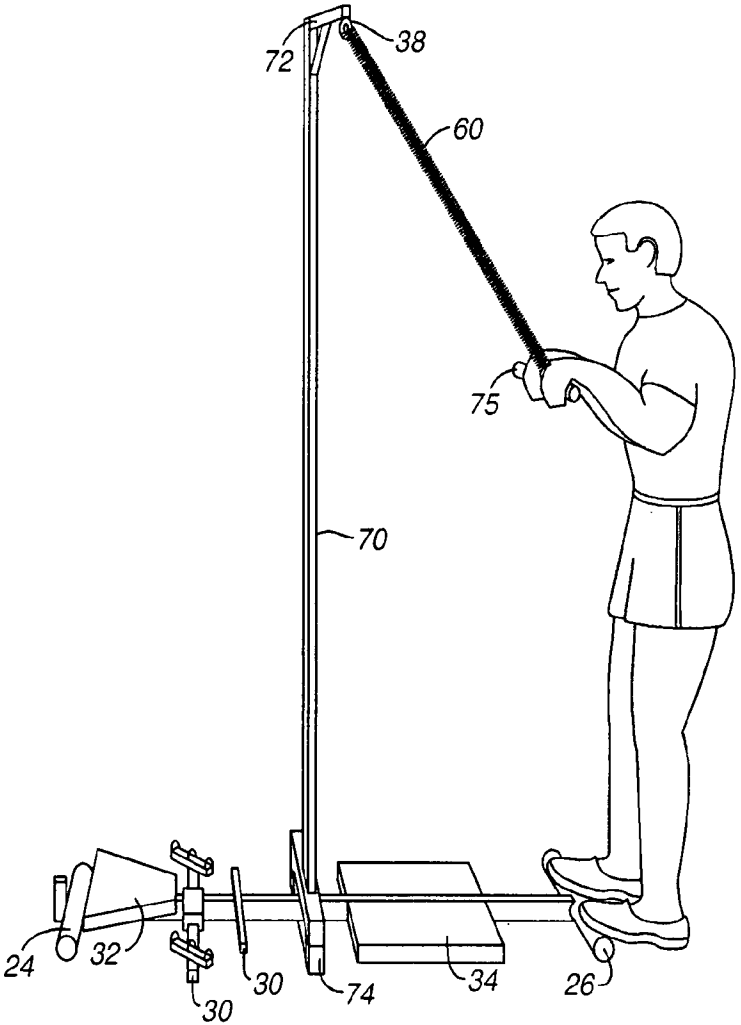
FIG. 14A is a perspective side view of a preferred embodiment of the exercise apparatus shown employed by a user in a first position during a tricep push exercise.

The full-body exercise apparatus 10 is shown in FIGS. 14A and 14B configured for use during a tricep push exercise. In this configuration of the preferred embodiment, the raised bench portion 40 and raised seat portion 50 will preferably be removed as shown. In FIG. 14A, the full-body exercise apparatus 10 is shown employed by a user during a first position in the tricep push exercise exercise. The full-body exercise apparatus 10 of the present invention is shown employed by a user in a second position during the tricep push exercise in FIG. 14B. As illustrated, at least one tension member 60 is employed to provide resistance during the exercise.

Figure 15B:
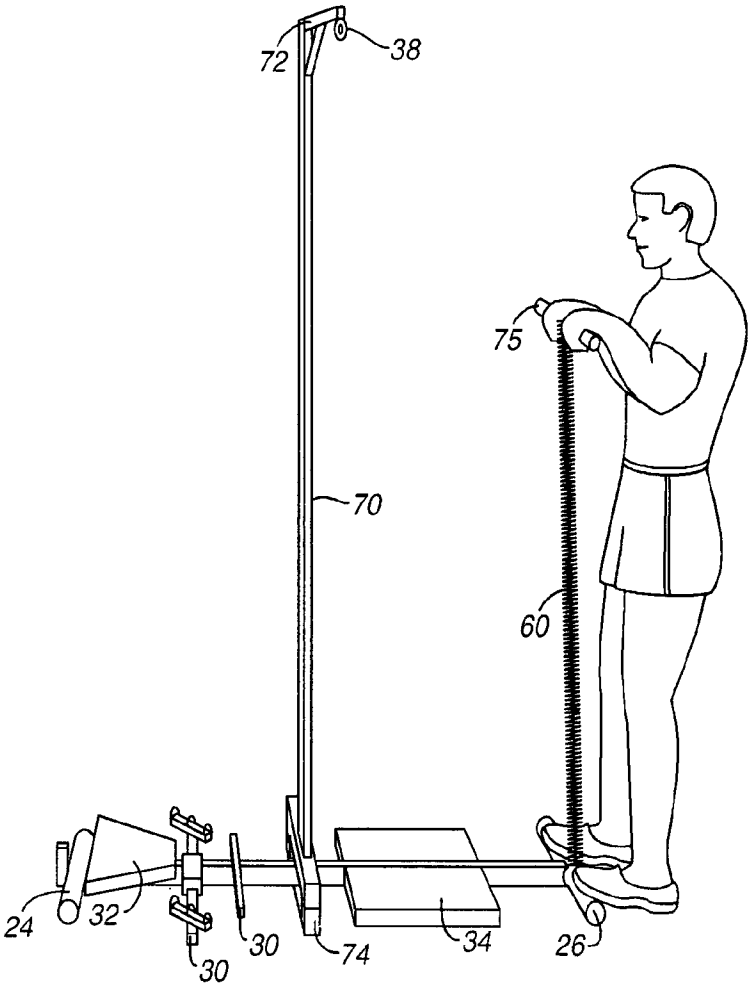
FIG. 15B is a perspective side view of a preferred embodiment of the exercise apparatus shown employed by a user in a second position during a forearm curl exercise.
Figure 15A:
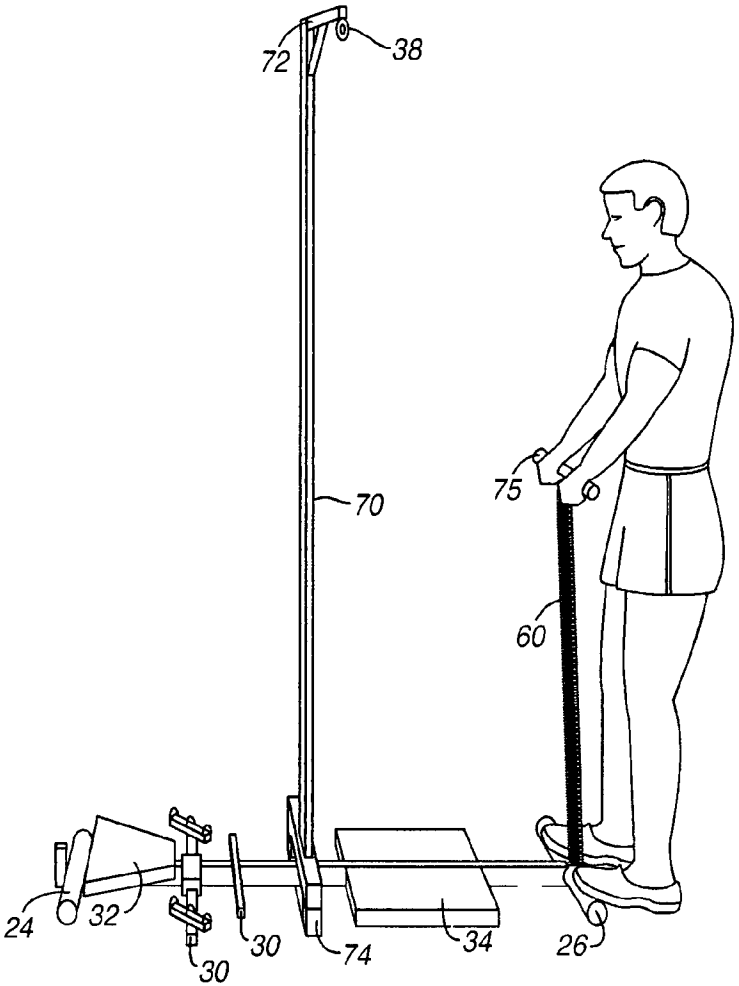
FIG. 15A is a perspective side view of a preferred embodiment of the exercise apparatus shown employed by a user in a first position during a forearm curl exercise.

The full-body exercise apparatus 10 is shown in FIGS. 15A and 15B configured for use during a forearm curl exercise. In this configuration of the preferred embodiment, the raised bench portion 40, raised seat portion 50, and pole section 70 may be removed if desired. In FIG. 15A, the full-body exercise apparatus 10 is shown employed by a user during a first position in the forearm curl exercise. The full-body exercise apparatus 10 of the present invention is shown employed by a user in a second position during the forearm curl exercise in FIG. 15B. As illustrated, at least one tension member 60 will be employed to provide resistance during the exercise.

Figure 16B:
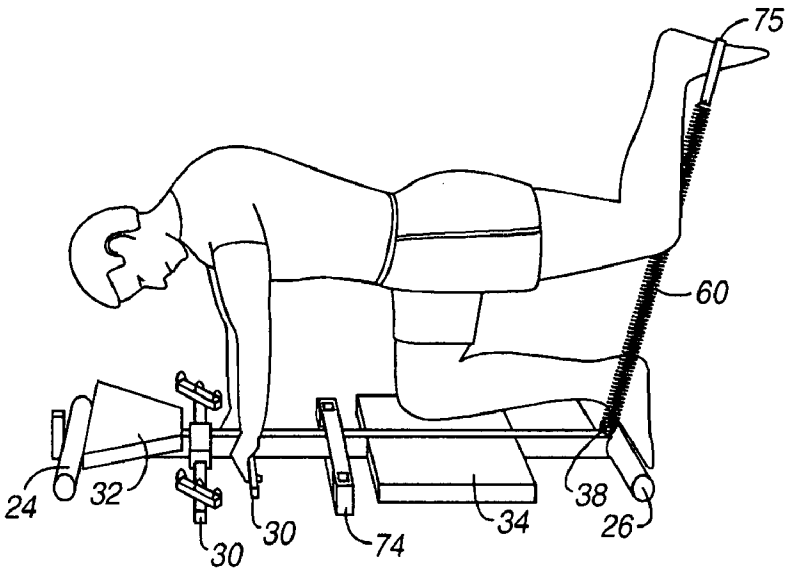
FIG. 16B is a perspective side view of a preferred embodiment of a portion of the base of the exercise apparatus of the present invention shown employed by a user in a second position during a bent-knee kick back exercise.
Figure 16A:
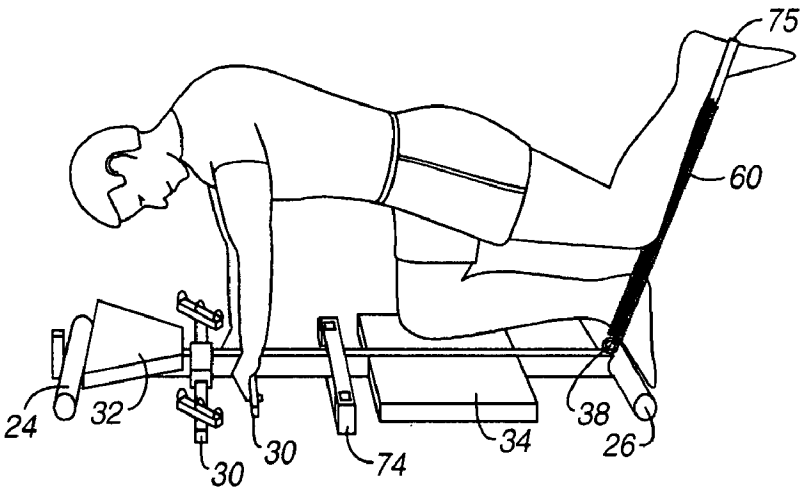
FIG. 16A is a perspective side view of a preferred embodiment of a portion of the base of the exercise apparatus of the present invention shown employed by a user in a first position during a bent-knee kick back exercise.

The full-body exercise apparatus 10 is shown in FIGS. 16A and 16B configured for use during a bent-knee kick back exercise. In this configuration of the preferred embodiment, the raised bench portion 90, raised seat portion 50, and pole section 70 will preferably be removed as shown. In FIG. 16A, the full-body exercise apparatus 10 is shown employed by a user during a first position in the bent-knee kick back exercise. The full-body exercise apparatus 10 of the present invention is shown employed by a user in a second position during the bent-knee kick back exercise in FIG. 16B. As illustrated, at least one tension member 60 will be employed to provide resistance during the exercise.

Figure 17B:
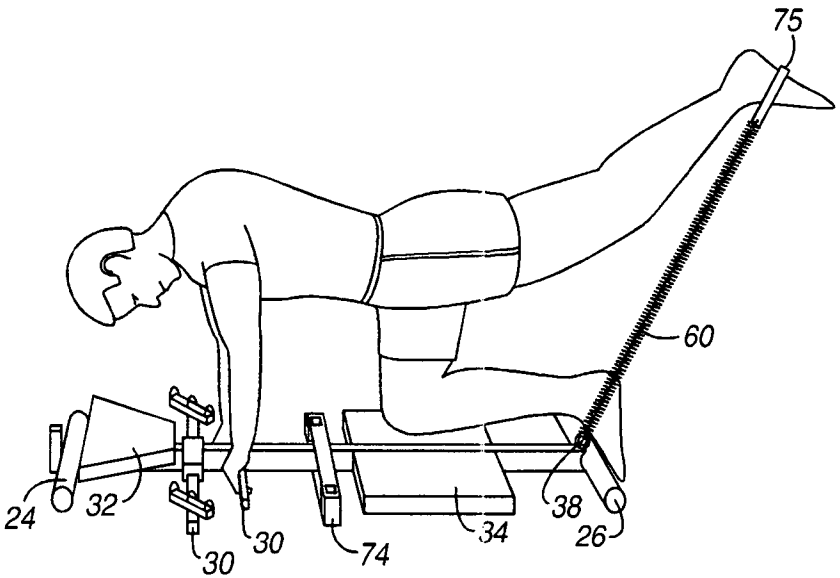
FIG. 17B is a perspective side view of a preferred embodiment of a portion of the base of the exercise apparatus of the present invention shown employed by a user in a second position during a straight-knee kick back exercise.
Figure 17A:
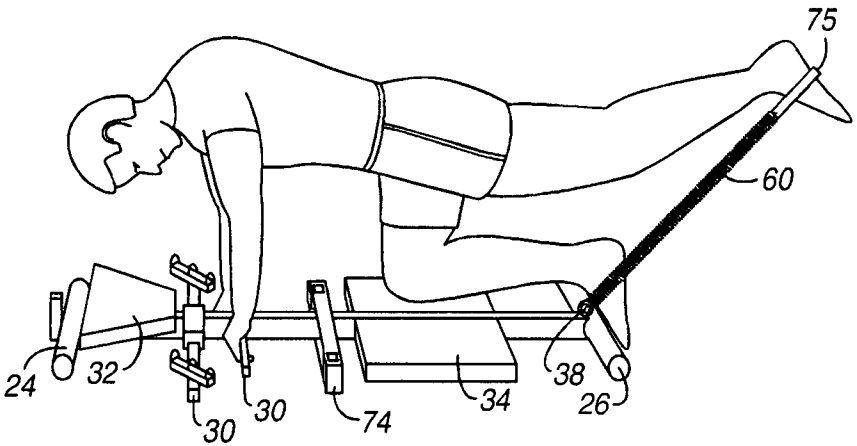
FIG. 17A is a perspective side view of a preferred embodiment of a portion of the base of the exercise apparatus of the present invention shown employed by a user in a first position during a straight-knee kick back exercise.

The full-body exercise apparatus 10 is shown in FIGS. 17A and 17B configured for use during a straight-knee kick back exercise. In this configuration of the preferred embodiment, the raised bench portion 40, raised seat portion 50, and pole section 70 will preferably be removed as shown. In FIG. 17A, the full-body exercise apparatus 10 is shown employed by a user during a first position in the straight-knee kick back exercise. The full-body exercise apparatus 10 of the present invention is shown employed by a user in a second position during the straight-knee kick back exercise in FIG. 17B. As illustrated, at least one tension member 60 will be employed to provide resistance during the exercise.

Figure 18B:
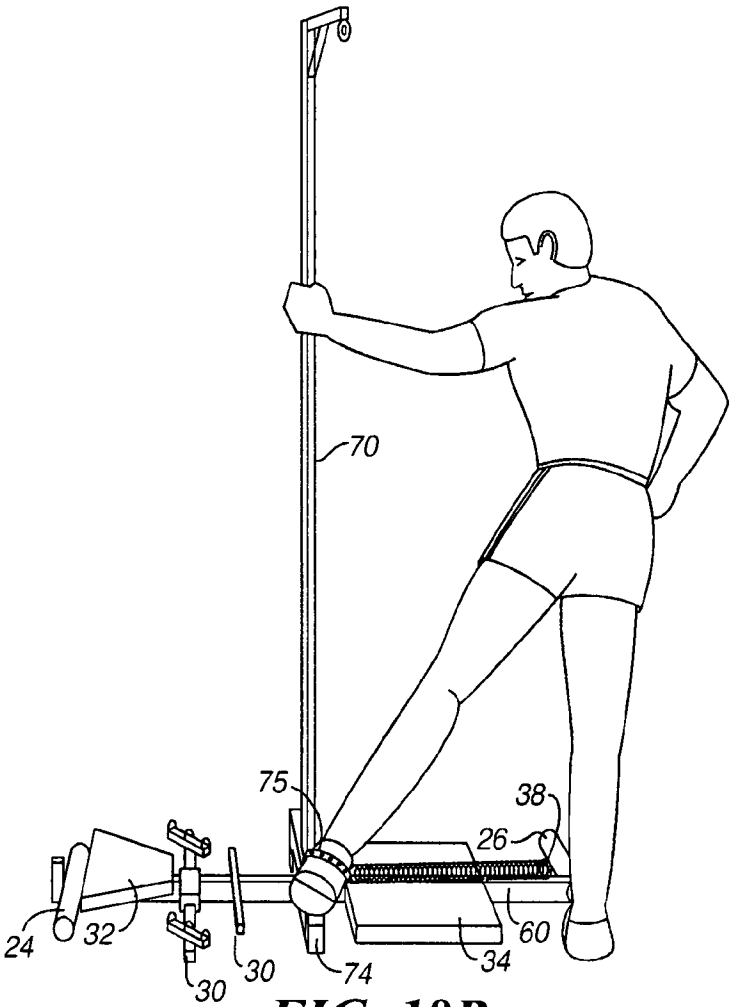
FIG. 18B is a perspective side view of a preferred embodiment of the exercise apparatus shown employed by a user in a second position during a leg raise exercise.
Figure 18A:
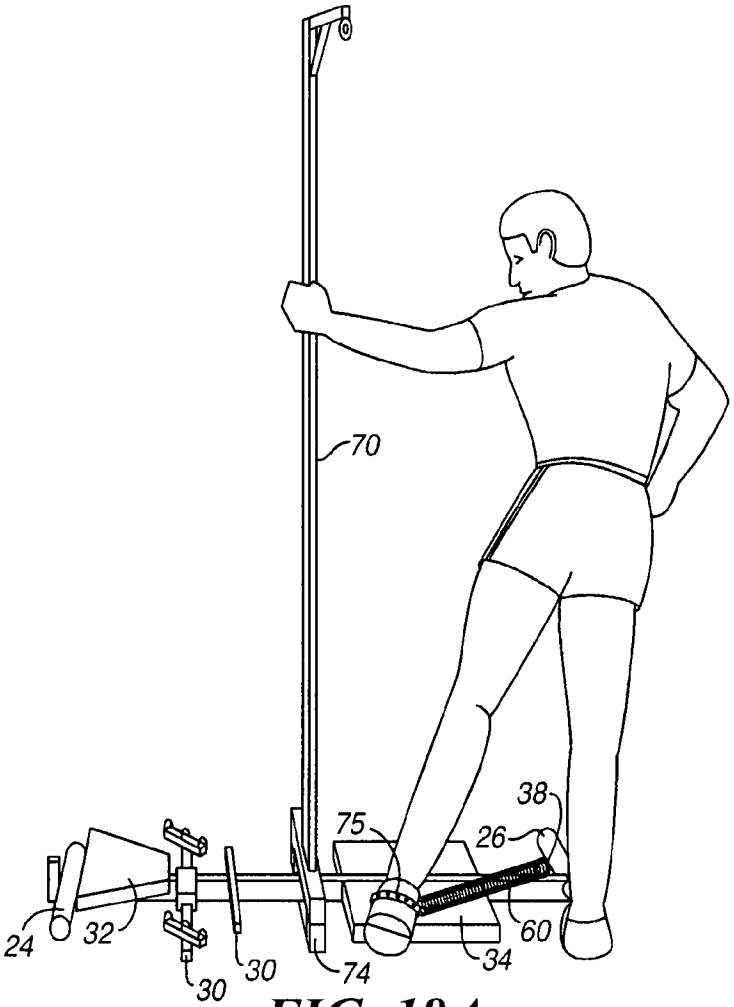
FIG. 18A is a perspective side view of a preferred embodiment of the exercise apparatus shown employed by a user in a first position during a leg raise exercise.

The full-body exercise apparatus 10 is shown in FIGS. 18A and 18B configured for use during a leg raise exercise. In this configuration of the preferred embodiment, the raised bench portion 40 and raised seat portion 50 may be removed if desired. The pole section 70 will preferably be utilized, as shown in FIGS. 18A and 18B, to provide a user with a support surface as illustrated. In FIG. 18A, the full-body exercise apparatus 10 is shown employed by a user in a first position during a leg raise exercise. The full-body exercise apparatus 10 of the present invention is shown employed by a user in a second position during a leg raise exercise in FIG. 18B. As illustrated, a tension member 60 is employed to provide resistance during the exercise. The leg raise exercise is illustrated in FIGS. 18A and 18B in a left-leg embodiment. It should be appreciated, however, that the leg raise exercise may be performed in a right leg embodiment as a mirror image thereof.

Figure 19B:
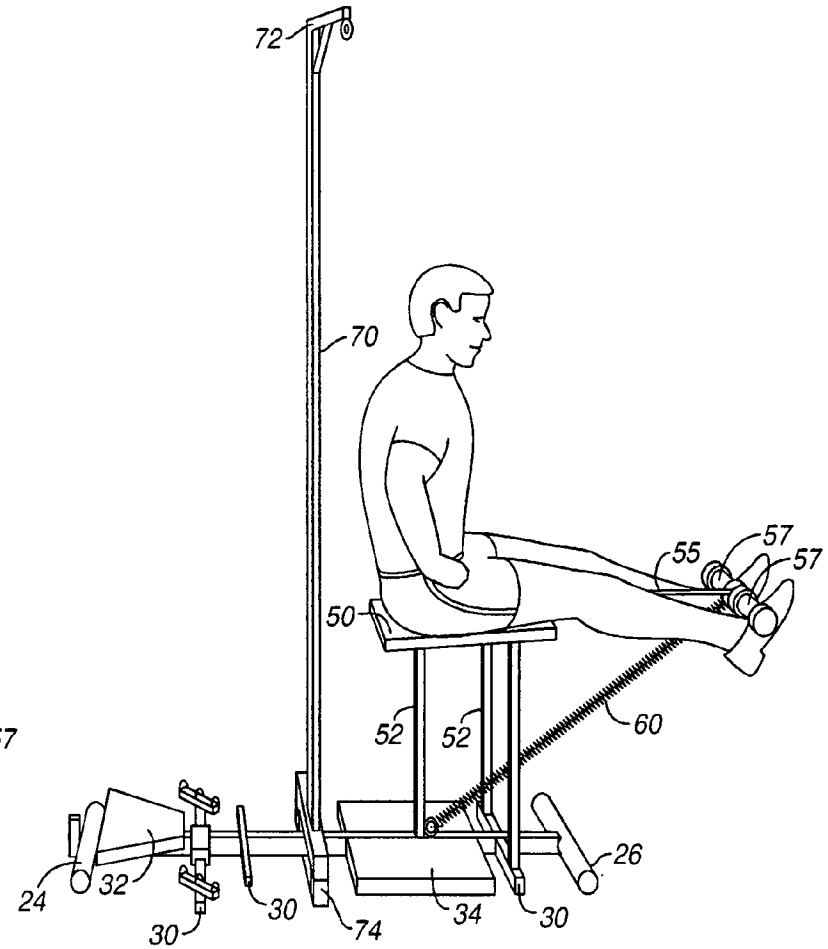
FIG. 19B is a perspective side view of a preferred embodiment of the exercise apparatus shown employed by a user in a second position during a leg extension exercise.
Figure 19A:
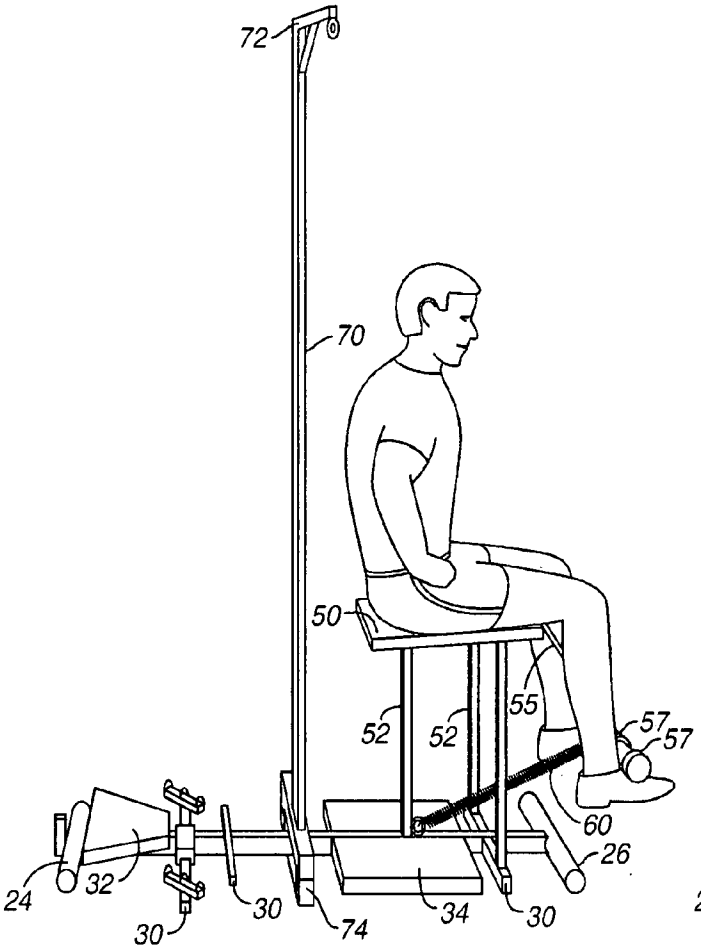
FIG. 19A is a perspective side view of a preferred embodiment of the exercise apparatus shown employed by a user in a first position during a leg extension exercise.

The full-body exercise apparatus 10 is shown in FIGS. 19A and 19B configured for use during a leg extension exercise. In this configuration of the preferred embodiment, the raised seat portion 50 will be utilized along with a pivoting hinged leg extension rod 55 as shown in FIGS. 19A and 19B. In FIG. 19A, the full-body exercise apparatus 10 is shown employed by a user in a first position during the leg extension exercise. The full-body exercise apparatus 10 of the present invention is shown employed by a user in a second position during the leg extension exercise in FIG. 19B. As illustrated, at least one tension member 60 is employed to provide resistance during the exercise.

Figure 20B:
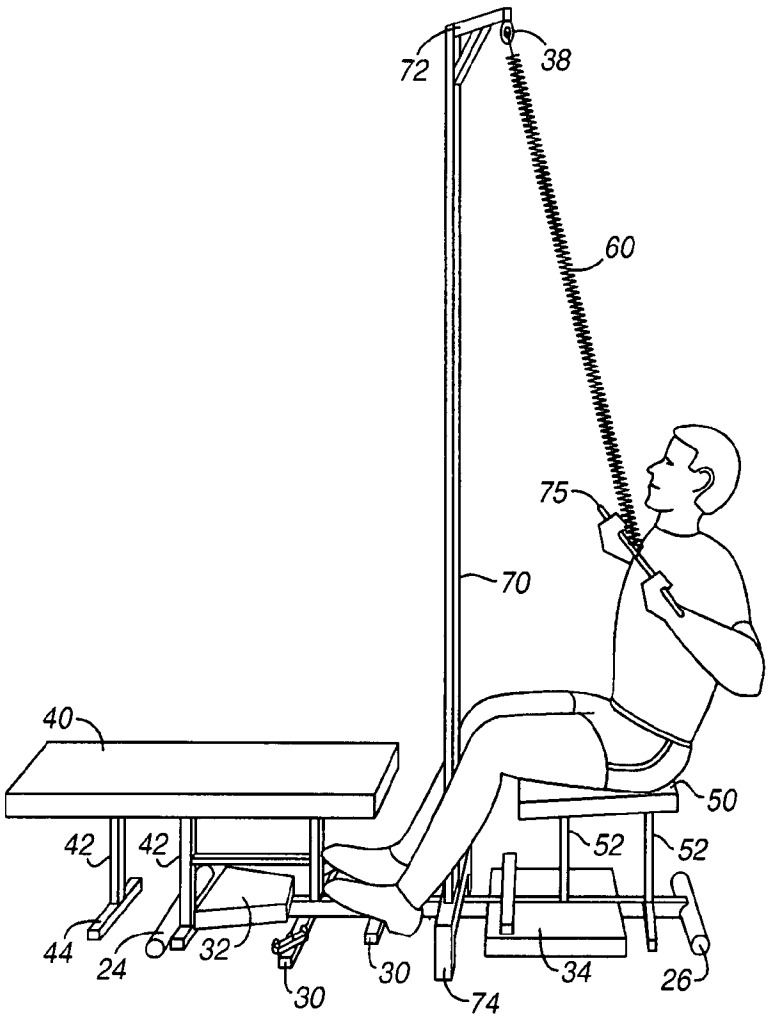
FIG. 20B is a perspective side view of a preferred embodiment of the exercise apparatus shown employed by a user in a second position during an inside grip pull down exercise.
Figure 20A:
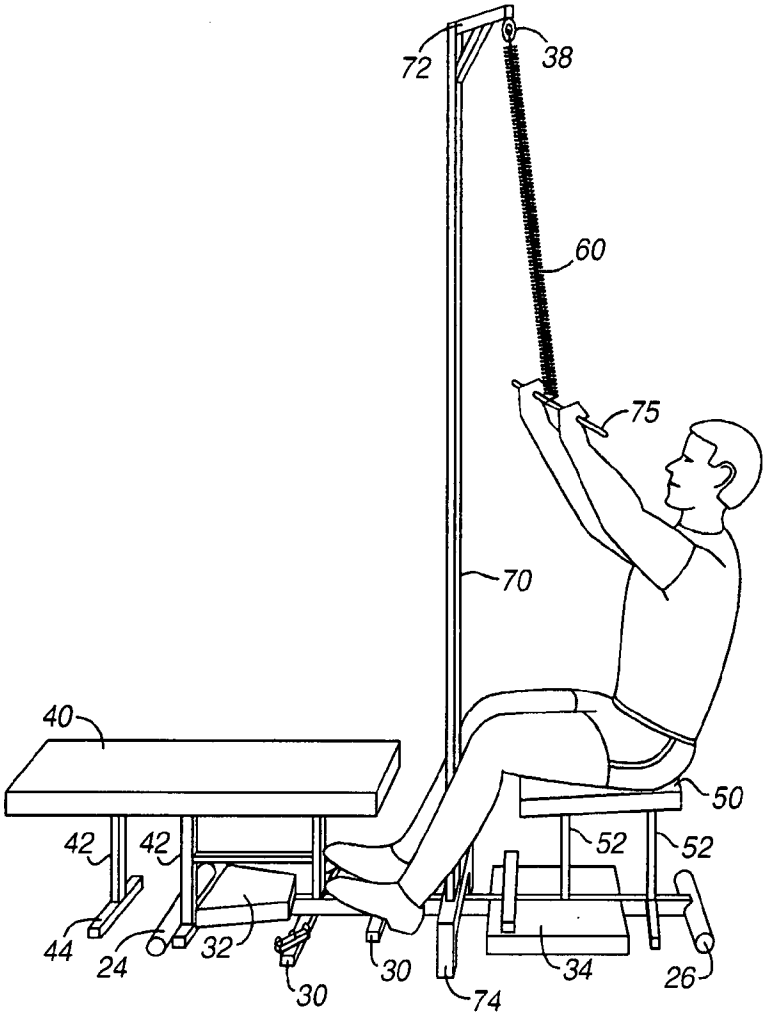
FIG. 20A is a perspective side view of a preferred embodiment of the exercise apparatus shown employed by a user in a first position during an inside grip pull down exercise.

The full-body exercise apparatus 10 is shown in FIGS. 20A and 20B configured for use during an inside grip lat pull exercise shown with a user in a rearwardly reclining position. In FIG. 20A, the full-body exercise apparatus 10 is shown employed by a user during a first position in the inside grip lat pull exercise. The full-body exercise apparatus 10 of the present invention is shown employed by a user in a second position during the inside grip lat pull exercise in FIG. 20B. As illustrated, at least one tension member 60 is employed to provide resistance during the exercise. Also, as will be appreciated by those skilled in the art, the free-style nature of the tension members permit a wide variety of muscular movement as desired by a user. As such, it is seen that in the position illustrated in FIGS. 11A and 11B, the user is sitting in a relatively upright manner in comparison to the rearwardly reclining posture adopted by the user in FIGS. 20A and 20B. It will be appreciated by those skilled in the art that the freedom of movement permitted to users during exercise provides for substantially improved muscular conditioning and development.

Figure 21B:
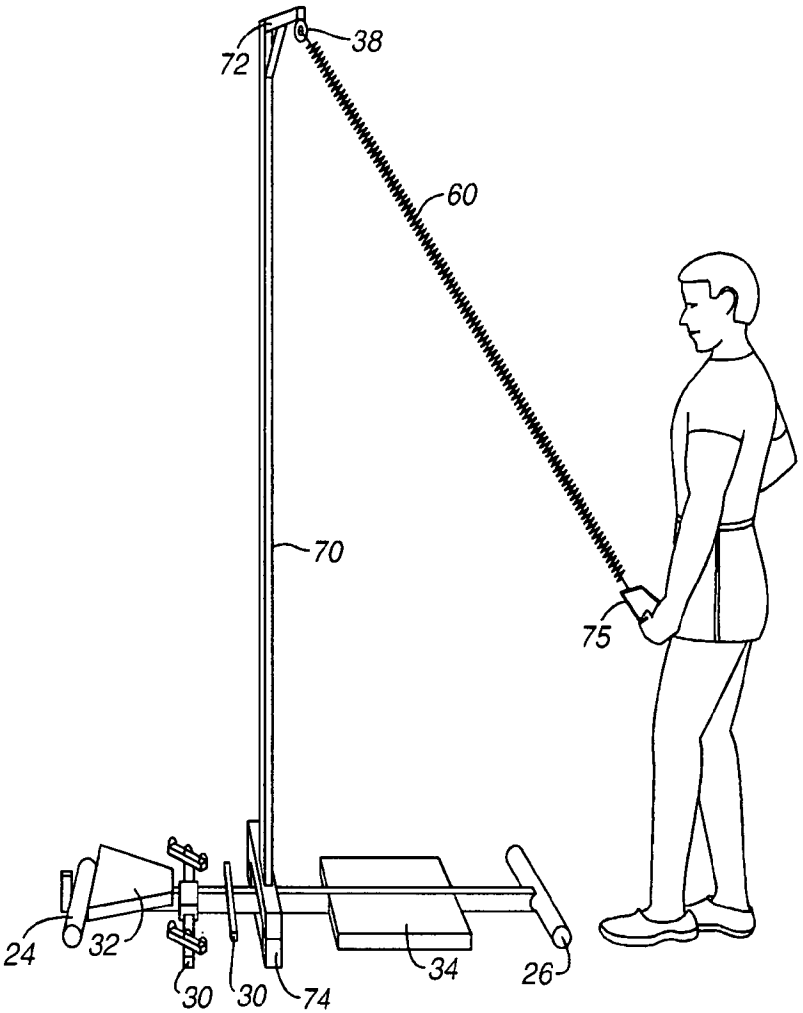
FIG. 21B is a perspective side view of a preferred embodiment of the exercise apparatus shown employed by a user in a second position during a one-hand tricep pull exercise.
Figure 21A:
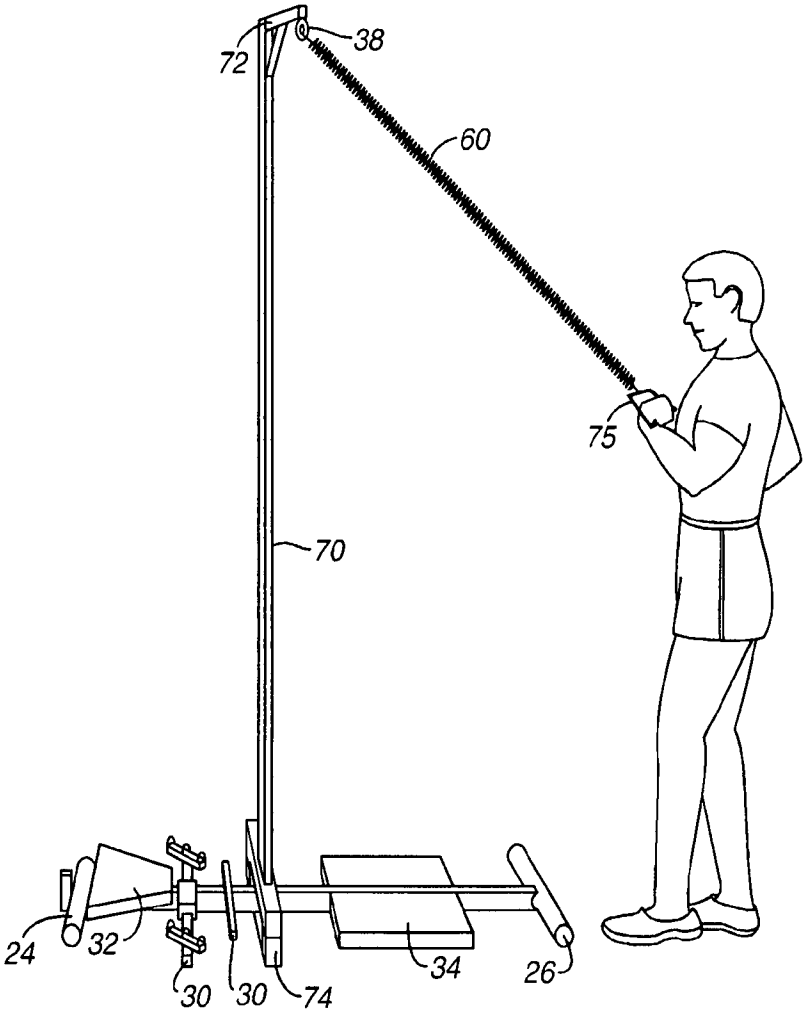
FIG. 21A is a perspective side view of a preferred embodiment of the exercise apparatus shown employed by a user in a first position during a one-hand tricep pull exercise.

The full-body exercise apparatus 10 is shown in FIGS. 21A and 21B configured for use during a one-hand tricep pull exercise. In this configuration of the preferred embodiment, the raised bench portion 40 and raised seat portion 50 will preferably be removed as shown. In FIG. 21A, the full-body exercise apparatus 10 is shown employed by a user during a first position in the tricep pull exercise. The full-body exercise apparatus 10 of the present invention is shown employed by a user in a second position during the tricep pull exercise in FIG. 21B. As illustrated, at least one member 60 is employed to provide resistance during the exercise.

Since many modifications, variations, and changes in detail can be made to the described preferred embodiments of the invention, it is intended that all matters in the forgoing description and shown in the accompanying drawings be interpreted as illustrative and not in a limiting sense. Thus, the scope of the invention should be determined by the appended claims and their legal equivalence.

I claim:

1. A full body exercise apparatus comprising:

a bottom frame structure having a front end portion, a rear end portion and a central axis extending therebetween, a seat pad disposed near said central axis of said bottom frame structure and configured to support a user thereupon, a knee pad disposed near said central axis of said bottom frame structure and configured to support a user thereupon, at least one pair of stabilizer arms extending from said central axis of said bottom frame structure, a pair of rotating pedals disposed upon said at least one pair of stabilizer arms, a pole section removably secured to said bottom frame structure and extending perpendicularly upwards therefrom, a raised seat portion removably secured to said bottom frame structure, a raised bench portion removably secured to said bottom frame structure, a plurality of tension members configured to be removably secured throughout said full body exercise apparatus, said tension members including a handle thereupon, and connection means configured to removably secure said tension members to said full body exercise apparatus.

2. A full body exercise apparatus as recited in claim 1, wherein said handle is removable.

3. A full body exercise apparatus as recited in claim 2, wherein said tension members comprise an elastic material.

4. A full body exercise apparatus as recited in claim 2 wherein said tension members comprise tightly coiled springs.

5. A full body exercise apparatus as recited in claim 2 wherein said bottom frame structure is comprised of a light weight metallic material.

6. A full body exercise apparatus as recited in claim 3 wherein said connection means comprise an eyelet.

7. A full body exercise apparatus as recited in claim 3 wherein each of said rotating pedals disposed on said stabilizing arm comprises a plurality of eyelets thereupon.

8. A full body exercise apparatus comprising:

a bottom frame structure having a front end portion, a rear end portion, and a central axis extending therebetween, a seat pad disposed near said central axis of said bottom frame structure and configured to support a user thereupon, a knee pad disposed near said central axis of said bottom frame structure and configured to support a user thereupon, at least one pair of stabilizer arms extending horizontally from said central axis of said bottom frame structure, a pair of rotating pedals disposed upon said at least one pair of stabilizer arms, a pole section removably secured to said bottom frame structure and extending vertically therefrom, a raised seat portion removably secured to said bottom frame structure, a raised bench portion removably secured to said bottom frame structure, a plurality of tension members configured to be removably secured throughout said full body exercise apparatus, said tension members including a removable handle thereupon, and connection means configured to removably secure said tension members to said full body exercise apparatus.

9. A full body exercise apparatus as recited in claim 8, wherein said pole section extends perpendically upwards from said central axis of said bottom frame structure.

10. A full body exercise apparatus as recited in claim 8, at least partially formed from a plurality of generally hollow tubular metallic members.

11. A full body exercise apparatus as recited in claim 8, wherein said connection means comprise eyelets.

12. A full body exercise apparatus comprising:

a bottom frame structure having a front end portion, a rear end portion and a central axis extending therebetween, a seat pad disposed on said central axis of said bottom frame structure and configured to support a user thereupon, a knee pad disposed near said central axis of said bottom frame structure and comprising two individual pads abutting said central axis of said bottom frame structure and configured to support a user thereupon, at least one pair of stabilizer arms extending from said central axis of said bottom frame structure, a pole section removably secured to said central axis generally near a midpoint between said front end portion and said rear end portion of said bottom frame structure and extending perpendicularly upwards therefrom, a raised seat portion removably secured to said bottom frame structure, a raised bench portion removably secured to said bottom frame structure, a plurality of tension members configured to be removably secured throughout said full body exercise apparatus, said tension members comprising tightly coiled springs and including a handle thereupon, and connection means configured to removably secure said tension members to said full body exercise apparatus.

* * * * *